US009506247B2

(12) United States Patent
Feldpausch et al.

(10) Patent No.: US 9,506,247 B2
(45) Date of Patent: Nov. 29, 2016

(54) TRANSPARENT PANEL SYSTEM FOR PARTITIONS

(71) Applicant: Steelcase Inc., Grand Rapids, MI (US)

(72) Inventors: Thomas G. Feldpausch, Hastings, MI (US); Mark T. Slager, Caledonia, MI (US); Marvin C. Knauf, Conklin, MI (US); Allen C. Hager, Grand Rapids, MI (US); Steven Keith Meek, Kentwood, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/670,928

(22) Filed: Mar. 27, 2015

(65) Prior Publication Data

US 2015/0275513 A1 Oct. 1, 2015

Related U.S. Application Data

(60) Provisional application No. 61/971,989, filed on Mar. 28, 2014.

(51) Int. Cl.

| | |
|---|---|
| ***E04H 1/00*** | (2006.01) |
| ***E04H 14/00*** | (2006.01) |
| ***E04H 3/00*** | (2006.01) |

(Continued)

(52) U.S. Cl.

CPC ..... *E04B 2/745* (2013.01); *E04B 2/7455* (2013.01); *E06B 1/18* (2013.01); *E06B 1/36* (2013.01); *E04B 2/765* (2013.01);

(Continued)

(58) Field of Classification Search

CPC ..... E04B 2/7453; E04B 2/78; E04B 2/72; E04B 2/00; E04B 2/56; E04B 2/721; E04B 1/82; E06B 3/4654; E06B 1/00; E06B 1/52; E06B 3/32; E06B 3/36; E04C 1/08

USPC ..... 52/241, 238.1, 242, 243, 243.1, 284, 52/582.1, 582.2

See application file for complete search history.

(56) References Cited

U.S. PATENT DOCUMENTS

| | | | |
|---|---|---|---|
| 1,000,094 | A | 8/1911 | Klemm |
| 1,000,943 | A | 8/1911 | Pritchard |

(Continued)

FOREIGN PATENT DOCUMENTS

| | | |
|---|---|---|
| BE | 637728 | 9/1963 |
| CA | 1127010 A1 | 7/1982 |

(Continued)

*Primary Examiner* — Mark Wendell

(74) *Attorney, Agent, or Firm* — Price Heneveld LLP

(57) ABSTRACT

A window assembly for partition walls. The window assembly includes a plurality of connector assemblies that are configured to be connected to a partition frame around an opening through the partition frame. Each connector assembly includes a base structure and at least one movable retainer that is biased towards an engaged position. The window assembly also includes a subframe including two pairs of elongated subframe members having opposite ends that are rigidly interconnected to define a generally rectangular central opening. The subframe further defines oppositely facing inner and outer side faces. The subframe includes a connecting portion protruding away from the inner side face and engaging the movable retainer to connect the subframe to the connector assemblies. The window assembly further includes at least one sheet of light-transmitting material secured to the subframe and extending across the central opening.

23 Claims, 15 Drawing Sheets

(51) Int. Cl.

| | |
|---|---|
| ***E04H 5/00*** | (2006.01) |
| ***E04H 6/00*** | (2006.01) |
| ***E04B 2/74*** | (2006.01) |
| ***E06B 1/18*** | (2006.01) |
| ***E06B 1/36*** | (2006.01) |
| *E04B 2/76* | (2006.01) |
| *E06B 3/54* | (2006.01) |
| *E06B 3/64* | (2006.01) |

(52) U.S. Cl.
CPC ..... *E04B 2002/7487* (2013.01); *E06B 3/5454* (2013.01); *E06B 3/64* (2013.01)

(56) References Cited

U.S. PATENT DOCUMENTS 1,013,395 A 1/1912 Pement et al.
1,180,726 A 4/1916 Keil
1,216,370 A 2/1917 Seng
1,270,014 A 6/1918 Conwell
1,406,537 A 2/1922 Choate
1,444,425 A 2/1923 Ogden
1,533,120 A 4/1925 Lasker
1,888,535 A 11/1932 Kreuger et al.
1,911,275 A 5/1933 Hanson
2,007,618 A 7/1935 Snead
2,054,856 A 9/1936 Fox et al.
2,068,243 A 1/1937 McLaughlin, Jr.
2,124,353 A 7/1938 Plym
2,166,361 A 7/1939 Lowry
2,183,619 A 12/1939 Meyers et al.
2,186,270 A 1/1940 Persson
2,228,358 A 1/1941 Lowry
2,231,514 A 2/1941 Verhagen
2,236,812 A 4/1941 Edwards et al.
2,239,173 A 4/1941 Madsen
2,249,257 A 7/1941 Rumney et al.
2,256,548 A 9/1941 Chaffee
2,260,104 A 10/1941 Henderson
2,268,269 A 12/1941 Toney et al.
2,293,648 A 8/1942 Horn
2,308,918 A 1/1943 Hertel et al.
2,346,495 A 4/1944 Lingel
2,367,610 A 1/1945 Randall
2,388,786 A 11/1945 Knight et al.
2,497,515 A 2/1950 Pearse
2,552,298 A 5/1951 Stiles
2,582,765 A 1/1952 Brew
2,599,811 A 6/1952 Clerk
2,614,665 A 10/1952 Floyd
2,640,232 A 6/1953 Price
2,651,084 A 9/1953 Goldberg
2,666,234 A 1/1954 Lester, Jr.
2,672,959 A 3/1954 Young
2,725,606 A 12/1955 Persson
2,766,855 A 10/1956 Johnson et al.
2,807,339 A 9/1957 Wagner
2,838,109 A 6/1958 Persson
2,840,202 A 6/1958 Hehr
2,883,717 A 4/1959 Arnd
2,902,727 A 9/1959 Samolis
2,912,078 A 11/1959 Kiehl et al.
2,928,144 A 3/1960 Persson
2,939,185 A 6/1960 Ader et al.
2,949,985 A 8/1960 Becker et al.
2,953,824 A 9/1960 Minick
2,965,935 A * 12/1960 Olsen ..... E06B 3/44 160/381
2,975,492 A 3/1961 Persson
2,989,787 A 6/1961 Smith
2,996,767 A 8/1961 Konil et al.
3,020,988 A 2/1962 Bransford, Jr.
3,037,589 A 6/1962 Cole
3,064,320 A 11/1962 Blaszkowski
3,099,337 A 7/1963 Hetman
3,100,320 A 8/1963 Frederick
3,125,191 A 3/1964 Singer et al.
3,151,715 A 10/1964 Hagerty
3,180,459 A 4/1965 Liskey, Jr.
3,184,801 A 5/1965 Fletcher
3,197,807 A 8/1965 Persson
3,201,831 A 8/1965 Cudini
3,203,053 A 8/1965 Lane et al.
3,212,225 A 10/1965 Neal
3,213,980 A 10/1965 Persson
3,238,574 A 3/1966 Martin et al.
3,239,976 A 3/1966 Hall
3,242,627 A 3/1966 Fountain
3,252,260 A 5/1966 Mills
3,256,668 A 6/1966 Downes
3,262,226 A 7/1966 Persson
3,310,927 A 3/1967 Persson
3,318,360 A 5/1967 Persson
3,320,710 A 5/1967 Byssing
3,360,893 A 1/1968 Wattelez
3,363,365 A 1/1968 Laepple
3,363,385 A 1/1968 Evans et al.
3,381,434 A 5/1968 Carson
3,381,438 A 5/1968 Bohnsack
3,389,522 A 6/1968 Hordis
3,420,003 A 1/1969 Cline
3,429,090 A 2/1969 Metelnick
3,445,080 A 5/1969 Flannelly
3,462,904 A 8/1969 Napler
3,487,602 A 1/1970 Braun et al.
3,503,168 A 3/1970 Eggert, Jr.
3,527,011 A 9/1970 Bloom et al.
3,563,577 A 2/1971 Wittenmayer
3,574,985 A 4/1971 Pierce
3,685,227 A 8/1972 Grisard et al.
3,744,201 A 7/1973 Dochnahl
3,749,432 A 7/1973 Janssen
3,750,358 A 8/1973 Lewkowitz
3,760,543 A 9/1973 McAllister
3,788,019 A 1/1974 Kiselewski
3,797,191 A 3/1974 Sukolics
3,837,118 A 9/1974 Goss, Jr. et al.
3,837,132 A 9/1974 Weller
3,861,085 A 1/1975 Jacob
3,868,789 A 3/1975 Gates
3,869,839 A 3/1975 Johnson et al.
3,885,367 A 5/1975 Thunberg
3,899,858 A 8/1975 Zanker
3,903,669 A 9/1975 Pease, Jr. et al.
3,919,815 A 11/1975 Alabaster
3,943,679 A 3/1976 Dissinger
3,964,225 A 6/1976 Yoshida
3,969,857 A 7/1976 Stark
3,971,178 A 7/1976 Mazzoni
3,994,243 A 11/1976 Anders
3,995,405 A 12/1976 Peterson
3,998,018 A 12/1976 Hodges
4,021,967 A 5/1977 Mulder et al.
4,031,680 A 6/1977 Stoakes
4,048,768 A 9/1977 Good
4,074,489 A 2/1978 Eckel
4,082,047 A 4/1978 Williams
4,089,143 A 5/1978 La Pietra
4,103,981 A 8/1978 Donahue et al.
4,126,975 A 11/1978 Williams
4,134,240 A 1/1979 Bologna et al.
4,187,657 A 2/1980 Sukolies
4,231,204 A 11/1980 Krueger et al.
4,241,556 A 12/1980 Bursk
4,246,731 A 1/1981 Miro
4,255,910 A 3/1981 Wendt
4,271,566 A 6/1981 Perina
4,280,309 A 7/1981 Huelsekopf
4,300,794 A 11/1981 Dunsmoor
4,327,796 A 5/1982 Rochman
4,370,828 A 2/1983 Miro
4,372,094 A 2/1983 Boschetti
4,407,100 A 10/1983 Huelsekopf
4,416,096 A 11/1983 Schuster et al.

(56) References Cited

U.S. PATENT DOCUMENTS 4,423,573 A 1/1984 Omholt et al.
4,428,154 A 1/1984 Rinehart
4,430,836 A 2/1984 McKann
4,471,589 A 9/1984 Schmidlin
4,488,391 A 12/1984 Pavnica
4,516,619 A 5/1985 Hasbrouck
4,523,408 A 6/1985 McConnell
4,525,961 A 7/1985 Hansen
4,539,243 A 9/1985 Miller
4,541,595 A 9/1985 Fiala et al.
4,542,924 A 9/1985 Brown et al.
4,550,542 A 11/1985 La See
4,563,846 A 1/1986 Webb
4,570,399 A 2/1986 Wentink
4,592,167 A 6/1986 Andrawos
4,625,479 A 12/1986 Giguere
4,630,411 A 12/1986 Salzer
4,631,881 A 12/1986 Charman
4,648,231 A 3/1987 Laroche
4,702,050 A 10/1987 Giguere
4,715,245 A 12/1987 Daloz
4,756,135 A 7/1988 Citrullo et al.
4,768,316 A 9/1988 Haas
4,782,630 A 11/1988 Kleyn
4,787,184 A 11/1988 Boidron
4,798,035 A 1/1989 Mitchell et al.
4,799,330 A 1/1989 Hudson
4,839,989 A 6/1989 McConnell
4,873,803 A 10/1989 Rundo
4,884,376 A 12/1989 DeBlock et al.
4,897,975 A 2/1990 Artwick et al.
4,905,428 A 3/1990 Sykes
4,920,718 A 5/1990 Artwick et al.
4,924,930 A 5/1990 Drennan
4,947,597 A 8/1990 Simpson
4,947,606 A 8/1990 La See
4,962,805 A 10/1990 Allen
4,972,640 A 11/1990 DeFazio
4,989,381 A 2/1991 De Block et al.
4,996,814 A 3/1991 Guillemet
4,999,958 A 3/1991 Harrison
5,018,330 A 5/1991 Lewkowitz
5,038,539 A 8/1991 Kelley et al.
5,054,255 A 10/1991 Maninfior
5,133,168 A 7/1992 Neilly et al.
5,155,955 A 10/1992 Ball et al.
5,165,737 A 11/1992 Riegelman
5,218,799 A 6/1993 Appino
5,242,207 A 9/1993 Carson et al.
5,245,788 A 9/1993 Riegelman
5,265,388 A 11/1993 Sherwood
5,307,599 A 5/1994 Herbst et al.
5,323,579 A 6/1994 Ruff
5,369,922 A 12/1994 Hansen
5,369,923 A 12/1994 Schilt
5,373,671 A 12/1994 Roth et al.
5,379,518 A 1/1995 Hopper
5,400,560 A 3/1995 Hellwig et al.
5,471,803 A 12/1995 Logan et al.
5,598,674 A * 2/1997 Lay ..... B32B 15/08 428/432
5,603,585 A * 2/1997 Bruchu ..... B29C 65/20 403/382
5,622,017 A * 4/1997 Lynn ..... B29C 65/20 52/204.5
5,653,076 A 8/1997 Habraken et al.
5,660,010 A 8/1997 Sayers
5,666,773 A * 9/1997 Librande ..... B29C 66/72523 160/369
5,675,948 A 10/1997 Boesch
5,692,349 A 12/1997 Guillemet
5,893,600 A 4/1999 McManus
5,941,022 A 8/1999 Schmuck
6,012,258 A 1/2000 Brown et al.
6,058,667 A 5/2000 MacDonald et al.
6,141,925 A 11/2000 Halvorson, Jr. et al.
6,151,849 A 11/2000 Twigg et al.
6,158,179 A 12/2000 Ackerly et al.
6,167,664 B1 1/2001 Reuter et al.
6,227,491 B1 5/2001 Stephan et al.
6,272,801 B1 8/2001 Suh
6,367,210 B1 4/2002 Trundle
6,390,718 B1 5/2002 Steege
6,513,288 B1 2/2003 MacDonald et al.
6,550,193 B2 4/2003 Potts
6,553,735 B1 4/2003 Wang Chen
6,581,344 B1 6/2003 Niewiadomski et al.
6,581,354 B1 6/2003 Skarpness
6,688,659 B2 2/2004 Kobrehel
6,763,647 B2 7/2004 Yeany
6,769,214 B1 8/2004 Kenkel et al.
6,775,953 B2 8/2004 Burken
6,786,453 B2 9/2004 Jones
6,805,185 B2 10/2004 Gravel et al.
6,883,277 B2 4/2005 Wiechecki et al.
6,931,810 B2 8/2005 Beaudoin et al.
6,981,724 B2 1/2006 Denys
7,010,888 B2 3/2006 Tumlin et al.
7,114,299 B2 10/2006 Ringness
7,124,543 B2 10/2006 Chubb
7,150,127 B2 12/2006 Underwood et al.
7,178,300 B2 2/2007 Elsing
7,331,142 B2 2/2008 Gerard
7,448,174 B2 11/2008 Krochmal et al.
7,461,484 B2 12/2008 Battey et al.
7,540,115 B2 6/2009 Metcalf et al.
7,634,885 B2 12/2009 Hoffmann
7,644,552 B2 1/2010 Kuipers et al.
7,676,999 B2 3/2010 Arias
7,707,796 B2 5/2010 Arias
7,752,816 B2 7/2010 Gunther et al.
7,891,148 B2 2/2011 Underwood et al.
7,908,805 B2 3/2011 Metcalf et al.
7,918,063 B2 4/2011 Etemadi
8,104,241 B2 1/2012 Andres
8,291,656 B2 10/2012 Gunther et al.
8,966,842 B2 3/2015 Hager et al.
2002/0095885 A1 7/2002 Sampson
2003/0089057 A1* 5/2003 Wiechecki ..... E04B 2/7427 52/238.1
2003/0115811 A1 6/2003 Sibbett
2004/0060253 A1* 4/2004 Elsing ..... E04B 2/7448 52/384
2004/0227349 A1 11/2004 Denys
2006/0130403 A1 6/2006 Krehbiel et al.
2007/0089369 A1 4/2007 Gore et al.
2008/0302054 A1 12/2008 Gosling et al.
2010/0115852 A1 5/2010 Daniels et al.
2010/0212375 A1 8/2010 Mitchell et al.
2012/0311946 A1 12/2012 Liu et al.
2014/0075869 A1* 3/2014 Hager ..... E05B 65/006 52/241
2014/0075871 A1 3/2014 Haan et al.

FOREIGN PATENT DOCUMENTS

CA 1214962 A1 12/1986
CA 2450636 A1 11/2004
CH 517887 A 1/1972
CH 552110 A 7/1974
CH 597489 A5 4/1978
CH 600125 A5 6/1978
CN 201817936 5/2011
DE 1052661 B 3/1959
DE 1281134 B 10/1968
DE 1509168 A1 1/1969
DE 1534884 A1 7/1969
DE 1922239 A1 11/1969
DE 2023309 11/1971
DE 2036962 3/1972
DE 2104387 A1 8/1972
DE 2105711 8/1972
DE 2155602 A1 5/1973
DE 2217877 A1 10/1973

(56) References Cited

FOREIGN PATENT DOCUMENTS

| | | | |
|---|---|---|---|
| DE | 2242431 | A1 | 2/1974 |
| DE | 2360661 | A1 | 6/1974 |
| DE | 2360667 | A1 | 6/1974 |
| DE | 2416390 | A1 | 11/1974 |
| DE | 2401496 | A1 | 7/1975 |
| DE | 2412464 | A1 | 9/1975 |
| DE | 2426718 | A1 | 12/1975 |
| DE | 2528531 | A1 | 1/1976 |
| DE | 2507753 | A1 | 8/1976 |
| DE | 2516036 | A1 | 10/1976 |
| DE | 2607937 | A1 | 9/1977 |
| DE | 1960024 | A1 | 10/1977 |
| DE | 2731466 | A1 | 2/1978 |
| DE | 2656035 | A1 | 6/1978 |
| DE | 2748487 | A1 | 5/1979 |
| DE | 2752928 | A1 | 5/1979 |
| DE | 2810710 | B1 | 6/1979 |
| DE | 2911673 | B1 | 10/1979 |
| DE | 2915255 | A1 | 10/1979 |
| DE | 2819733 | A1 | 11/1979 |
| DE | 2940811 | A1 | 4/1980 |
| DE | 2945148 | A1 | 7/1980 |
| DE | 2915329 | A1 | 10/1980 |
| DE | 2945134 | A1 | 5/1981 |
| DE | 2951185 | A1 | 6/1981 |
| DE | 3009729 | A1 | 9/1981 |
| DE | 3142169 | A1 | 6/1982 |
| DE | 3102921 | A1 | 7/1982 |
| DE | 3103548 | A1 | 8/1982 |
| DE | 3107997 | A1 | 9/1982 |
| DE | 3131985 | A1 | 3/1983 |
| DE | 3140756 | A1 | 4/1983 |
| DE | 3045551 | A1 | 5/1983 |
| DE | 3211427 | A1 | 10/1983 |
| DE | 3425047 | A1 | 1/1985 |
| DE | 3420883 | C2 | 2/1985 |
| DE | 3405519 | A1 | 8/1985 |
| DE | 3432021 | A1 | 3/1986 |
| DE | 3434406 | A1 | 3/1986 |
| DE | 3524347 | A1 | 1/1987 |
| DE | 3627096 | A1 | 2/1988 |
| DE | 268022 | | 5/1989 |
| DE | 3801564 | A1 | 8/1989 |
| DE | 3812819 | A1 | 10/1989 |
| DE | 4027335 | C2 | 5/1993 |
| DE | 4142151 | A1 | 7/1993 |
| DE | 4203483 | A1 | 8/1993 |
| DE | 19533273 | A1 | 3/1997 |
| DE | 19834962 | C1 | 3/2000 |
| DE | 19944872 | A1 | 4/2001 |
| DE | 102006009620 | A1 | 9/2007 |
| EP | 0007324 | A1 | 2/1980 |
| EP | 0078503 | A1 | 5/1983 |
| EP | 0082338 | A1 | 6/1983 |
| EP | 0093364 | A2 | 11/1983 |
| EP | 0102500 | A2 | 3/1984 |
| EP | 0163374 | A1 | 12/1985 |
| EP | 0231338 | A1 | 8/1987 |
| EP | 0240401 | A1 | 10/1987 |
| EP | 0266314 | A1 | 4/1988 |
| EP | 0307953 | A2 | 3/1989 |
| EP | 0315612 | A1 | 5/1989 |
| EP | 0467047 | A2 | 1/1992 |
| EP | 0626494 | A1 | 11/1994 |
| EP | 0752512 | A1 | 1/1997 |
| EP | 0937856 | A2 | 8/1999 |
| EP | 1302601 | A1 | 4/2003 |
| EP | 1617032 | A1 | 1/2006 |
| FR | 1221507 | A | 6/1960 |
| FR | 1464678 | A | 1/1967 |
| FR | 2154913 | A5 | 5/1973 |
| FR | 2230841 | A1 | 12/1974 |
| FR | 2408027 | A1 | 6/1979 |
| FR | 2491524 | A1 | 4/1982 |
| FR | 2518159 | A1 | 6/1983 |
| FR | 2540174 | A1 | 8/1984 |
| FR | 2554862 | A1 | 5/1985 |
| FR | 2561300 | A1 | 9/1985 |
| FR | 2593850 | A1 | 8/1987 |
| FR | 2623238 | A1 | 5/1989 |
| FR | 2625250 | A3 | 6/1989 |
| FR | 2639995 | A1 | 6/1990 |
| FR | 2648178 | A1 | 12/1990 |
| FR | 2669673 | A1 | 5/1992 |
| FR | 2695689 | A1 | 3/1994 |
| FR | 2716695 | A1 | 9/1995 |
| GB | 298111 | A | 10/1928 |
| GB | 409604 | A | 5/1934 |
| GB | 476547 | A | 12/1937 |
| GB | 512601 | A | 9/1939 |
| GB | 589889 | A | 7/1947 |
| GB | 638234 | | 6/1950 |
| GB | 651090 | | 3/1951 |
| GB | 667007 | | 2/1952 |
| GB | 706881 | A | 4/1954 |
| GB | 817526 | A | 7/1959 |
| GB | 872870 | A | 7/1961 |
| GB | 1000943 | A | 8/1965 |
| GB | 1010789 | A | 11/1965 |
| GB | 1013395 | A | 12/1965 |
| GB | 1034246 | A | 6/1966 |
| GB | 1159159 | A | 7/1969 |
| GB | 1216370 | A | 12/1970 |
| GB | 1236958 | A | 6/1971 |
| GB | 1254419 | A | 11/1971 |
| GB | 1274118 | A | 5/1972 |
| GB | 1444425 | A | 7/1976 |
| GB | 1533120 | A | 11/1978 |
| GB | 2030627 | A | 4/1980 |
| GB | 2051197 | A | 1/1981 |
| GB | 2121858 | A | 1/1984 |
| GB | 2130629 | A | 6/1984 |
| GB | 2150626 | A | 7/1985 |
| GB | 2190418 | A | 11/1987 |
| GB | 2196045 | A | 4/1988 |
| GB | 2202260 | A | 9/1988 |
| GB | 2204347 | A | 11/1988 |
| GB | 2275709 | A | 7/1994 |
| GB | 2317145 | A | 3/1998 |
| NL | 60343 | | 7/1947 |
| WO | 8200292 | A1 | 9/1982 |
| WO | 8809423 | A1 | 12/1988 |
| WO | 9012187 | A1 | 10/1990 |
| WO | 9113221 | A1 | 9/1991 |
| WO | 9119877 | A1 | 12/1991 |
| WO | 9101853 | A1 | 2/1992 |
| WO | 9320320 | A2 | 10/1993 |
| WO | 9408122 | A1 | 4/1994 |

* cited by examiner

TRANSPARENT PANEL SYSTEM FOR PARTITIONS

CROSS REFERENCE TO RELATED APPLICATION

This application claims the benefit of U.S. Provisional Application No. 61/971,989 filed on Mar. 28, 2014, entitled "TRANSPARENT PANEL SYSTEM FOR PARTITIONS," the entire contents of which are incorporated herein by reference.

BACKGROUND OF THE INVENTION

Various types of partition systems have been developed for office buildings and other such applications. Known partition systems may include a plurality of panels that may comprise cloth, wood, and/or other such materials. Partitions may also include one or more "glass" panels having sheets of transparent or light transmitting material. However, known panels may suffer from various drawbacks.

SUMMARY OF THE INVENTION

One aspect of the present invention is a partition including a partition frame having a pair of horizontally spaced apart upright partition frame members, and a pair of vertically spaced apart horizontal partition frame members that are connected to the vertical frame members to define a generally rectangular frame opening therebetween. The partition includes at least one connector assembly adjacent to the rectangular frame opening. The connector assembly includes at least one movable retainer defining an engaged position. The movable retainer is biased towards the engaged position. The movable retainer includes a cam surface and a first retaining surface. The partition further includes a window subassembly configured to be installed to the partition frame at the frame opening. The window subassembly includes a generally rectangular subframe defining a central opening. A sheet of light-transmitting material is connected to the subframe, and extends across the central opening. The subassembly includes a connecting portion that is configured to initially engage the cam surface of the movable retainer as the window subassembly is moved into an installed position, and to move the movable retainer away from its engaged position, followed by movement of the movable retainer to its engaged position due to the bias. The connecting portions of the window subassembly include a second retaining surface that engages the first retaining surface when the movable retainer is in its engaged position to retain the window subassembly on the partition frame.

Another aspect of the present invention is a window assembly for partition walls. The window assembly includes a plurality of connector assemblies that are configured to be connected to a partition frame around an opening through the partition frame. Each connector assembly includes a base structure and at least one movable retainer that is biased towards an engaged position. The window assembly also includes a subframe including two pairs of elongated subframe members having opposite ends that are rigidly interconnected to define a generally rectangular central opening. The subframe further defines oppositely facing inner and outer side faces. The subframe includes a connecting portion protruding away from the inner side face and engaging the movable retainer to connect the subframe to the connector assemblies. The window assembly further includes at least one sheet of light-transmitting material secured to the subframe and extending across the central opening.

Another aspect of the present invention is a method of securing a window assembly to an upright partition frame, wherein the partition frame has a pair of horizontally spaced apart upright partition frame members having elongated channels facing one another, and a pair of vertically spaced apart horizontal partition frame members having elongated channels facing one another. The upright partition frame members and the horizontal partition frame members define an enlarged frame opening. The method includes providing a plurality of connector assemblies, each having a base structure and at least one movable retainer member that is connected to the base structure and biased towards an engaged position. The method further includes connecting at least one connector assembly to each upright partition frame member by inserting at least a portion of the base structure into the channels of the upright partition frame members. The method further includes connecting at least one connector assembly to each horizontal partition frame member by inserting at least a portion of each base structure into the channels of the horizontal partition frame members. The method still further includes providing a window assembly having a generally rectangular perimeter frame having a central opening. The window assembly includes a sheet of light-transmitting material extending across the central opening, and a plurality of connecting portions. The method further includes causing the connecting portions of the window assembly to engage the movable retainer members to shift the movable retainer members away from their engaged positions, followed by movement of the movable retainer members to their engaged positions in which the movable retaining member engage the connecting portions of the window assembly and secure the window assembly to the upright partition frame.

BRIEF DESCRIPTION OF THE DRAWINGS

FIG. 2;

DETAILED DESCRIPTION

Figure 1:
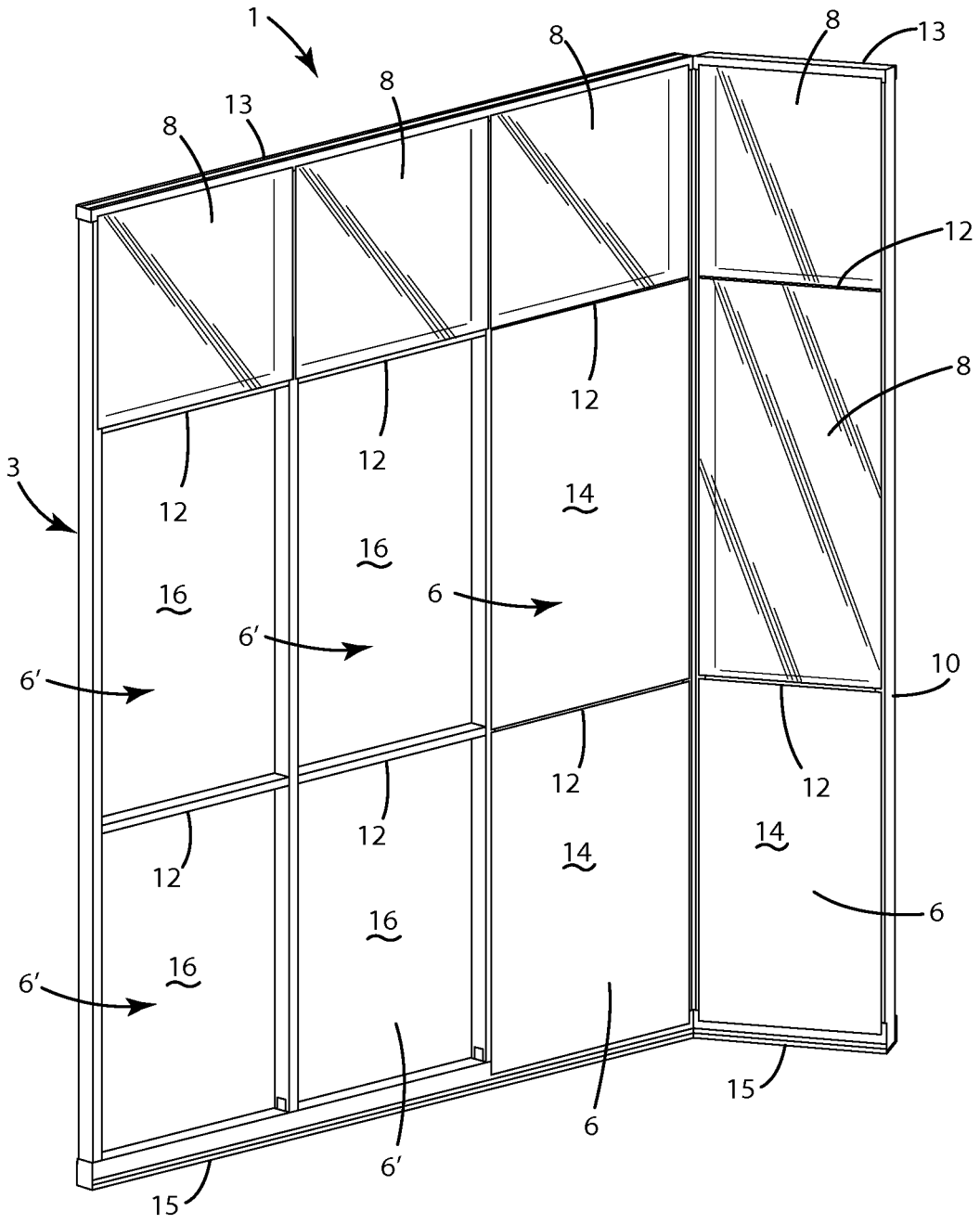
FIG. 1 is an isometric view of a panel system including glass or window panels according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present application is related to U.S. patent application Ser. No. 14/588,504, U.S. Pat. Nos. 8,850,762, 8,955,271, 8,959,859, 8,966,842, and U.S. Patent Application Publication Nos. 2014/0075757, 2014/0075862, 2014/0075867, and 2014/0075868 each of which is incorporated herein by reference.

Figure 2:
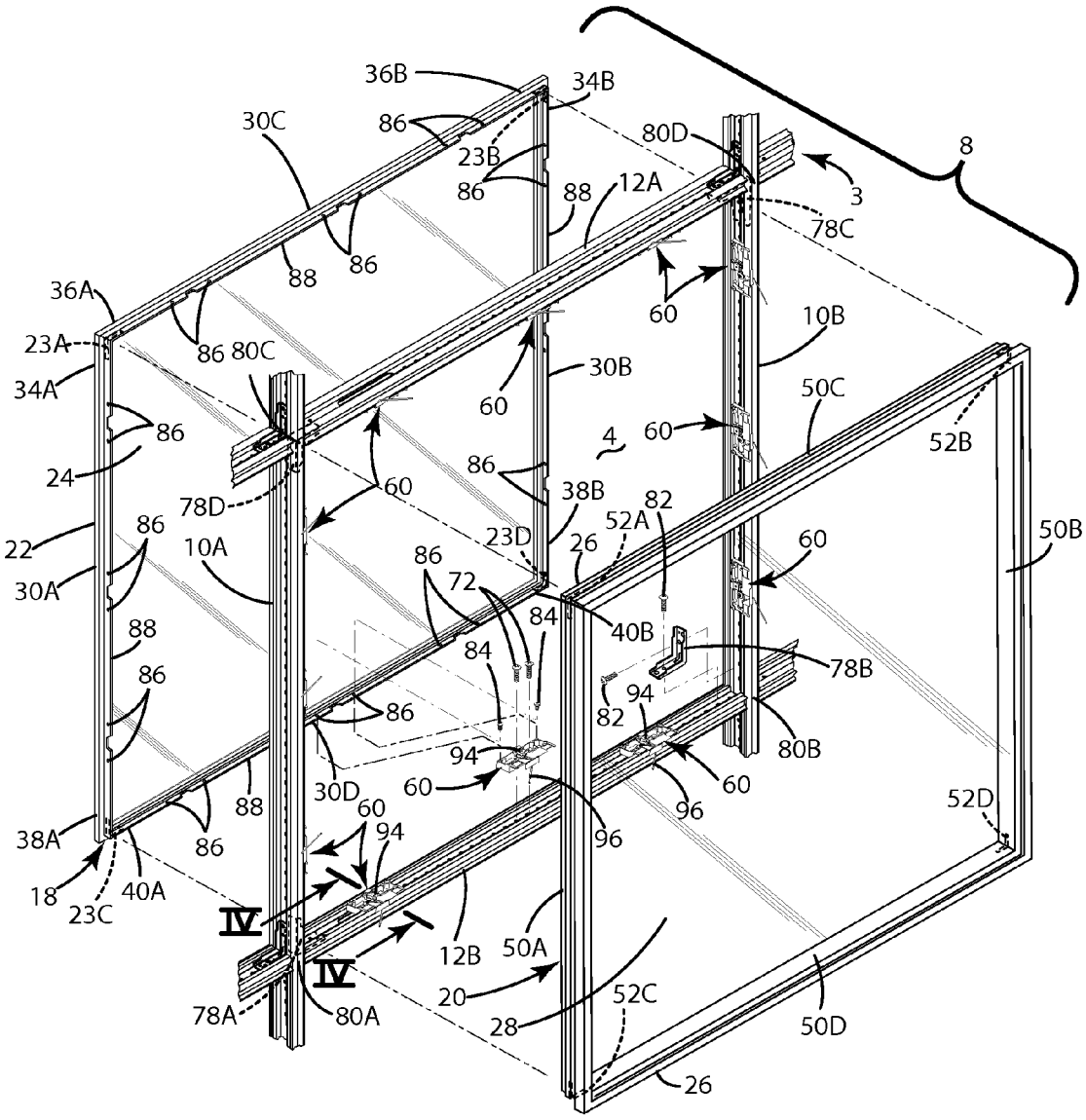
FIG. 2 is a partially fragmentary, exploded isometric view of a glass panel assembly according to one aspect of the present invention.

Referring now to FIG. 1, the reference numeral 1 generally designates a reconfigurable floor-to-ceiling panel wall system for use in office spaces and other environments. In the illustrated example, the reconfigurable panel wall system 1 includes a partition frame assembly 3 that supports a plurality or series of panel assemblies 6 in a floor-to-ceiling arrangement. As shown in FIGS. 1 and 2, the partition frame assembly 3 includes a plurality of vertical partition frame members 10 and horizontal partition frame members 12 with a ceiling track 13 disposed along an upper portion, and cover members or base assemblies 15 disposed along a lower portion. Vertical partition frame members 10 and horizontal partition frame members 12 include a pair of outwardly-opening channels 11 (FIG. 4) that may be utilized to secure a resilient light/sound seal member 17 (FIG. 9) to partition frame members 10 and 12. The partition frame members 10 and 12 may comprise a suitable metal such as steel that is formed to provide the required configuration. The partition frame members 10 and 12 may also comprise aluminum or other material that is extruded. The panel wall system 1 includes various types of skin assemblies shown in FIG. 1 as solid or opaque skin or panel assemblies 6, 6' and translucent or glass panel assemblies 8. The translucent or glass window panel assemblies 8 are generally adapted to allow light to pass therethrough for illuminating an office space arrangement according to a user's design preferences. However, as discussed in more detail below, glass panel assemblies 8 may include a translucent or transparent sheet of glass or polymer that has been coated on one side (typically the inner side) with paint or ink to provide a panel that partially or completely blocks light. Similarly, mirrors or other such sheets of material may be mounted in the glass panel assemblies 8. Thus, although the terms "glass panel assembly" or window panel assembly are generally used herein, the glass/window panels of the present invention are not limited to transparent or other light-transmitting sheets of material unless the claims expressly recite such limitations.

The solid panel assemblies 6 generally include an outer facing aesthetic surface 14, shown on panel assemblies 6, and an inwardly facing inner surface 16, as shown on panel assemblies 6'. In assembly, the panel wall system 1 is configured to have a first skin or panel assembly 6 disposed on one side of the partition frame assembly 3, with a second skin assembly 6' disposed on an opposite side of the partition frame assembly 3 in a substantially parallel spaced apart relationship.

Figure 5:
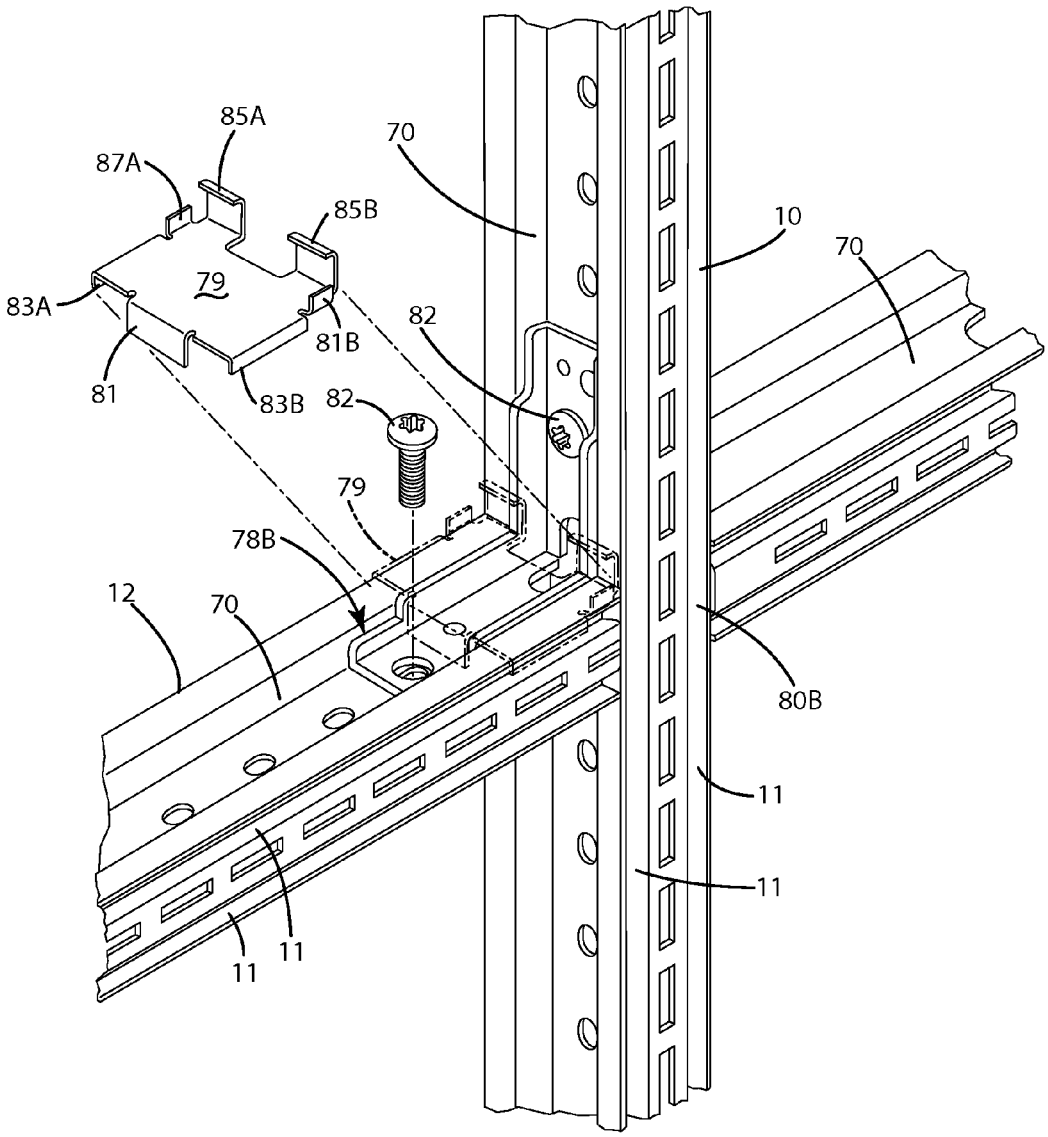
FIG. 5 is a partially fragmentary isometric view of a corner bracket and load bracket of the glass panel of FIG. 2.

With further reference to FIG. 2, glass or window panel assembly 8 includes first and second subassemblies 18 and 20, respectively, that are mounted in a frame opening 4 formed by vertical and horizontal partition frame members 10 and 12, respectively. Corner brackets 78A and 78B may be installed at the intersections 80A and 80B at the lower corners of the frame opening 4 utilizing screws 82 (see also FIG. 5). The corner brackets 78A-78D rigidly interconnect vertical and horizontal partition frame members 10 and 12, respectively. First subassembly 18 comprises a generally rectangular first subframe 22 and a first sheet of material 24 that is retained within the first subframe 22. Second subassembly 20 includes a generally rectangular second subframe 26 and a sheet of material 28 that is retained within the second subframe 26. The first and second sheets of material 24 and 28, respectively, may comprise transparent glass, transparent polymer material, tinted glass or polymer, frosted glass or polymer, opaque glass or polymer, an opaque material (e.g. cloth, metal, or wood) or virtually any other sheet of solid material as required for a particular application. In general, the first and second sheets of material 24 and 28, respectively, may comprise tinted glass or polymer material that is generally translucent, or the sheets 24 and 28 may comprise a sheet of opaque material. Furthermore, any of the various types of materials may be partially or completely coated with paint or the like to provide specific visual effects including frosted or painted designs, lettering, etc. Sheets 24 and 28 are typically about 0.25 inches or 0.375 inches thick, but may have any thickness as required. As used herein, the term "glass" may refer to virtually any type of material that can be mounted in the frames 22 and/or 26, and the term "glass" is not necessarily limited to transparent glass or polymer material.

The first subframe 22 includes upright or vertical subframe members 30A and 30B that are connected to horizontal subframe members 30C and 30D. As discussed in more detail below, the subframe members 30A-30D may comprise aluminum extrusions having substantially identical cross-sectional shapes. Upper ends 34A and 34B of upright subframe members 30A and 30B, respectively, are rigidly interconnected to opposite ends 36A and 36B of upper horizontal frame member 30C by L-shaped brackets 32A and 32B. Lower ends 38A and 38B of upright subframe members 30A and 30B, respectively, are rigidly interconnected with opposite ends 40A and 40B of lower horizontal frame member 30D utilizing L-shaped brackets 32C and 32D. The L-shaped brackets 32A-32D may comprise steel brackets that are received in channels or openings of subframe members 30A-30D to form a tight interference fit to rigidly interconnect the subframe members 30A-30D in a known manner. Corner brackets of this type are generally known in the art, such that these components will not be described in detail.

Figure 6:
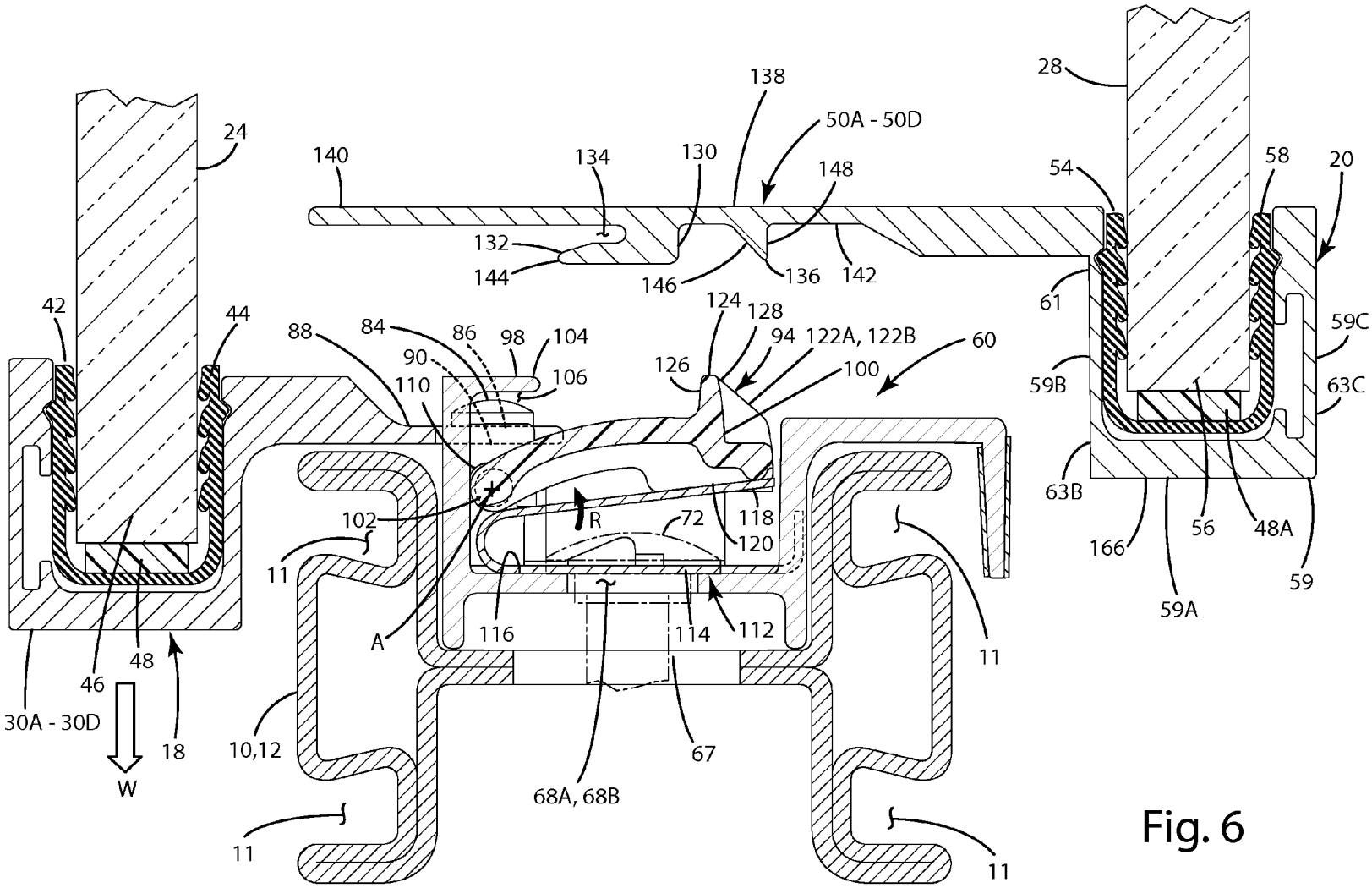
FIG. 6 is a partially exploded cross sectional view showing assembly of the glass panel of FIG. 2.

With further reference to FIG. 6, the subframe members 30A-30D each include a channel 42 that receives a U-shaped resilient member 44. Edge portions 46 of sheet 24 are received in the channels 42, and are supported by the resilient members 44 disposed in the channels 42. A resilient strip of material 48 may be positioned between sheet 24 and U-shaped resilient member 44 to cushion sheet 24. During assembly, edge portions 46 of sheet 24 are positioned in channels 42, and L-shaped brackets 32A-32D are utilized to rigidly interconnect subframe members 30A-30D.

Referring again to FIG. 2, the second subassembly 20 includes subframe members 50A-50D that are interconnected by L-shaped corner brackets 52A-52 D in substantially the same manner as discussed above in connection with first subassembly 18. The subframe members 50A-50D comprise aluminum extrusions having substantially identical cross sectional shapes (see also FIG. 6) The subframe members 50A-50D include a U-shaped channel 58 (FIG. 6) that receives a U-shaped resilient member 54, a resilient strip 48A, and edge portions 56 of the second sheet of material 28. During assembly, edge portions 56 of sheet 28 are inserted into channel 58, and corner brackets 52A-52D are utilized to rigidly interconnect subframe members 50A-50D.

U-shaped channel 58 (FIG. 6) may be formed by a perimeter flange structure 59 including a base wall 59A and spaced apart inner and outer sidewalls 59B and 59C, respectively, whereby the perimeter flange structure 59 is U-shaped in cross section. Inner sidewalls 59B define an inner side face or surface 63B, and outer sidewalls 59C define an outer side face or surface 63C. As discussed in more detail below, a connecting flange portion 138 of subframe members 50A-50D connects second subassembly 20 to partition frame assembly 3. Connecting flange portion 138 extends transversely from an end portion 61 of inner sidewall 59B. When second subassembly 20 is installed on partition frame 3 (FIG. 7), perimeter flange structure 59 overlaps or covers one of the channels 11.

Figure 3:
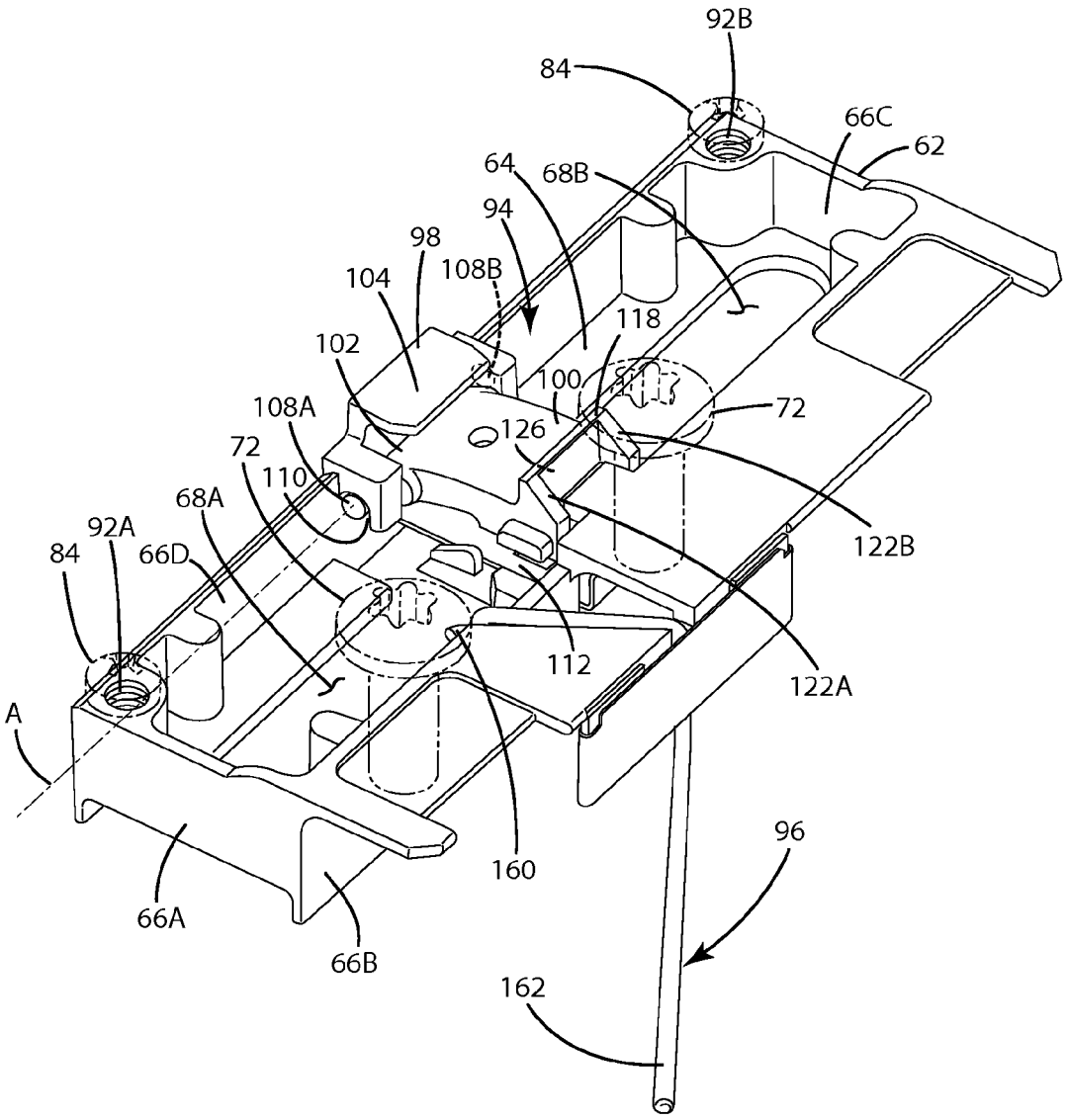
FIG. 3 is an isometric view of a bracket assembly of the glass panel of FIG. 2.

Referring again to FIG. 2, glass panel assembly 8 includes a plurality of connector or support bracket assemblies 60 that are secured to the vertical partition frame members 10 and to the horizontal partition frame members 12. The support bracket assemblies 60 support the first subassembly 18 on the partition frame assembly 3. The connector or support bracket assemblies 60 also separately and independently support the second subassembly 20 on the partition frame assembly 3. With further reference to FIG. 3, each support bracket assembly 60 includes a base structure 62 that may be formed from metal (e.g. cast aluminum) or other suitable material having sufficient strength to support the first and second subassemblies 18 and 20. The base structure 62 includes a bottom wall 64 and side walls 66A-66D that extend transversely from the bottom wall 64. The sidewalls 66A-66D may be integrally formed with the bottom wall 64.

Figure 4:
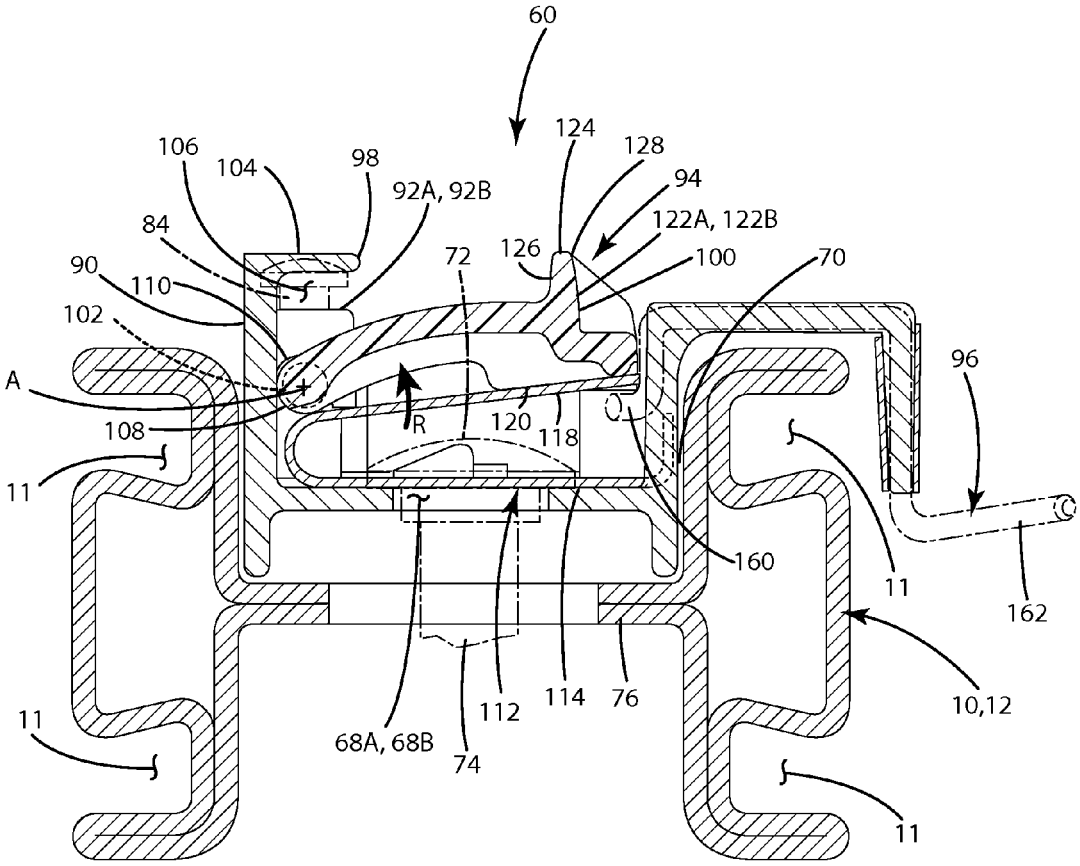
FIG. 4 is a cross sectional view of a bracket assembly and horizontal frame member taken along the line IV-IV.

During assembly, support bracket assemblies 60 are positioned in channels 70 (see also FIG. 5) in vertical partition frame members 10 and in channels 70 of horizontal partition frame members 12 as shown in FIG. 4. Vertical partition frame members 10 have substantially the same cross sectional configuration as the horizontal partition frame members 12, such that support bracket assemblies 60 attach to the vertical partition frame members 10 and horizontal partition frame members 12 in substantially the same manner. The number of support bracket assemblies 60 that are attached to the vertical partition frame members 10 and to the horizontal partition frame members 12 may be varied as required to support first and second subassemblies 18 and 20 of different sizes. For example, three of the support bracket assemblies 60 may be mounted to upper horizontal partition frame member 12A (FIG. 2), and three of the support bracket assemblies 60 may be mounted to the lower horizontal partition frame member 12B. Similarly, three support brackets assemblies 60 may be mounted to a vertical partition frame member 10A, and three support bracket assemblies 60 may be mounted to vertical partition frame member 10B. If the first and second subassemblies 18 and 20, respectively, are larger, additional support bracket assemblies 60 may be attached to the partition frame members 10A, 10B, 12A, and 12B as required to provide proper support. Conversely, fewer support bracket assemblies 60 may be utilized if subassemblies 18 and 20 are smaller and/or lighter.

During assembly, screws 72 are inserted through elongated slots or openings 68A and 68B in bottom wall 64 of support bracket assembly 60 (FIG. 3), and the screws 72 are threadably engaged with threaded openings 74 (FIG. 4) in vertical partition frame members 10 and horizontal partition frame members 12. The threaded openings 74 may comprise clip nuts or other threaded fasteners that engage transverse walls 76 of partition frame members 10 and 12. Alternatively, the threaded openings 74 may be formed directly in the transverse wall 76 of partition frame members 10 and 12. The screws 72 may comprise shoulder bolts that loosely retain support bracket assemblies 60 on partition frame members 10 and 12 after the screws 72 are tightened.

After the support bracket assemblies 60 are secured to the partition frame members 10A, 10B, 12A, and 12B utilizing screws 72, load brackets 79 (FIG. 5) may optionally be positioned at the lower corners of frame opening 4. Upwardly extending tabs 87A, 87B of load brackets 79 engage the first subframe 22 and/or second subframe 26 of first and second subassemblies 18 and 20, respectively. A tab 81 and flanges 83A, 83B locate and center the load brackets 79 on partition frame members 12. When glass panel 8 is assembled, the lower ends of subframe members 30A, 30B of first subassembly 18 and/or the lower ends of subframe members 50A, 50B of second subassembly 20 engage support flanges 85A and/or 85B of load brackets 79 to support the subassemblies 18 and 20. With further reference to FIG. 6, the sheet of material 24 of first subassembly 18 may be quite large, generating a significant downwardly acting force "W." Also, the edge portions 46 of sheet 24 disposed along vertical subframe members 30A and 30B (FIG. 2) may generate forces that act downwardly on subframe members 30A and 30B. The load brackets 79 support the lower ends 38A and 38B of vertical side subframe members 30A and 30B and thereby prevent bending and/or twisting and/or other distortions of the subframe members 30A-30D that could otherwise occur. The load brackets 79 are optional, and may not be required if first subassembly 18 and/or second subassembly 20 are relatively small and/or if the sheets of material 24 and/or 28 are relatively light weight.

After installation of the load brackets 79, the first subassembly 18 is then positioned in the frame opening 4 of frame 3 with flanges 88 of subframe members 30A-30D overlapping upper edge portions 90 (see also FIG. 6) of the support bracket assemblies 60. Screws 84 are then inserted through openings 86 in flange 88 of subframe members 30A-30D into threaded openings 92A and 92B (FIG. 3) of support bracket assemblies 60. The subframe members 30A-30D of first subassembly 18 are thereby directly connected to each of the support bracket assemblies 60 such that the first subassembly 18 is supported on frame 3 by the support bracket assembly 60 and load brackets 79.

Referring again to FIG. 2, after first subassembly 18 is attached to the partition frame 3, the second subassembly 20 is aligned with frame opening 4, and the second subassembly 20 is inserted into the frame opening 4, thereby causing the subframe members 50A-50D to engage connectors 94 of support bracket assembly 60. Locking members 96 of support bracket assemblies 60 are then shifted to prevent disengagement of subframe members 50A-50D from connectors 94 of support bracket assemblies 60.

With reference to FIG. 3, connectors 94 of support bracket assemblies 60 include a stationary retainer 98 that is integrally formed with the base structure 62, and a movable retaining members 100 having a first base or end 102 that is rotatably connected to the base structure 62. The stationary retainer 98 includes a transversely extending tab or flange 104 that forms a gap 106 (see also FIG. 6).

First or base end 102 of movable retaining members 100 includes cylindrical extensions 108A and 108B (FIG. 3) that rotatably engage a pivot structure 110 that is integrally formed with base structure 62 to thereby rotatably interconnect movable retaining members 100 with base structure 62 for rotation about an axis "A" (FIG. 3). A spring clip 112 includes a lower portion or leg 114 that engages a upwardly facing surface 116 of bottom wall 64 of base structure 62. The spring clip 112 also includes an upper leg 118 that contacts a lower surface 120 of movable retaining member 100 to thereby rotatably bias the movable retaining members 100 upwardly as shown by the arrow "R" (FIGS. 4 and 6) about axis A. Outer or distal end 124 of movable retaining member 100 includes a transversely extending tapered portion 128 having angled ramp or cam surfaces 122A and 122B that generally face away from base end 102, and a first retaining surface 126 that generally faces towards base end 102. When bracket assembly 60 is oriented as shown in FIG. 6 (e.g. it is connected to a lower horizontal partition frame member 12B; FIG. 2), transverse portion 128 extends upwardly. However, it will be understood that transverse portion 128 may also extend horizontally or downwardly if bracket assembly 60 is attached to vertical partition frame members 10A or 10B or to upper horizontal frame member 12A, respectively (FIG. 2).

Figure 7:
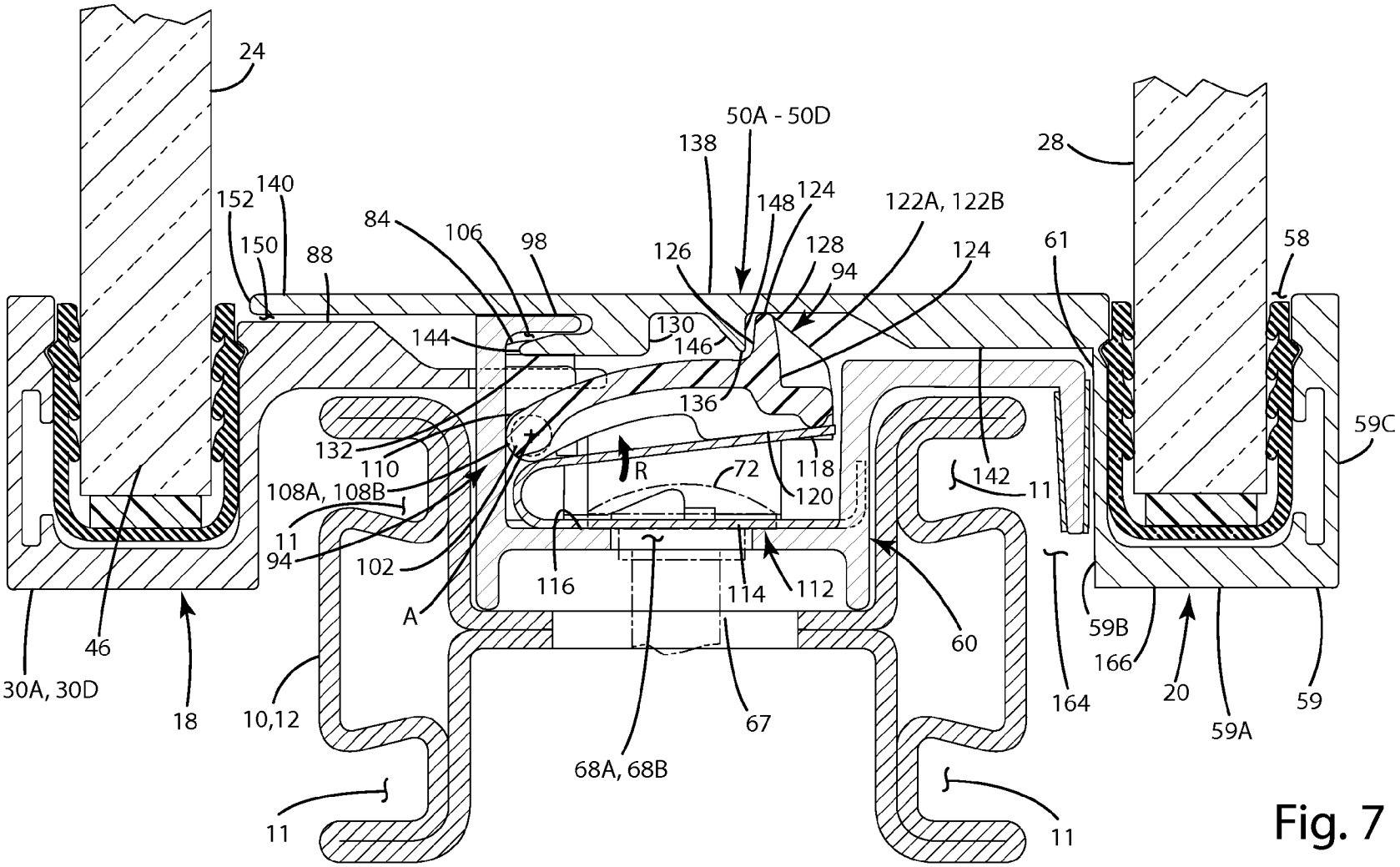
FIG. 7 is a partially fragmentary cross sectional view of the glass panel of FIG. 6 following assembly.

With reference to FIGS. 6 and 7, extrusions or subframe members 50A-50D include a connecting flange portion 138 having an upper or inner side surface 140 that faces frame opening 4, and a lower or outer side surface 142 that faces away from frame opening 4. First and second retaining structures 130 and 136 extend outwardly from the lower side surface 142. The first retaining structure 130 includes a retaining structure such as cantilevered retaining flange 132 that is spaced apart from lower surface 142 to form a gap 134. Second retaining structure 136 includes an angled or sloped side surface 146 and a second retaining surface 148 that together define a barb. The subframe members 50A-50D have a uniform cross sectional shape along the length of the subframe members 50A-50D, and the first and second retaining structures 130 and 136, respectively, extend along the length of the subframe members 50A-50D.

As the second subassembly 20 is pushed into the frame opening 4 of frame 3 (FIG. 2), ends or edges 144 of retaining flanges 132 initially contact the angled ramp surfaces 122A and 122B of movable retaining members 100. As the edge 144 slides along the angled ramp surfaces 122A and 122B, the outer end 124 of movable retaining member 100 rotates downwardly against the bias generated by spring clip 112 about the axis A. As the subframe members 50A-50D are moved further into the frame opening 4, angled surface 146 of second retaining structure 136 comes into contact with angled ramp surfaces 122A and 122B of movable retaining member 100, causing the movable retaining member 100 to again rotate downwardly against the bias of spring clip 112. When the subframe members 50A-50D are shifted to the fully installed position, spring clip 112 causes movable retainer 100 to rotate upwardly to the position shown in FIG. 7. When subassembly 20 is fully installed, the retaining flanges 132 of first retaining structures 130 are received in the gap 106 of stationary retainer 98 of base structure 62 of support bracket assembly 60 (see also FIG. 3), and the second retaining structure 136 is disposed adjacent upper extension 128 of movable retaining members 100, with surface 148 of second retaining structure 136 in contact with (or directly adjacent) retaining surface 126 of extension 128 of movable retaining members 100. The bias generated by spring clip 112 causes the movable retaining members 100 to rotate upwardly to the retaining position shown in FIG. 7 to thereby prevent inadvertent dislodgement of second subassembly 20 from the partition frame 3.

In general, when the second subassembly 20 is secured to the support bracket assemblies 60, edges 152 of connecting flanges 138 of subframe members 50A-50D are spaced apart from the transparent sheet 24 and subframe members 30A-30D to form a gap 150. The subframe members 50A-50D are supported by the support bracket assembly 60, and the subframe members 50A-50D do not normally engage or contact the subframe members 30A-30D or other components of the first subassembly 18 when glass panel 8 is fully assembled.

Figure 8A:
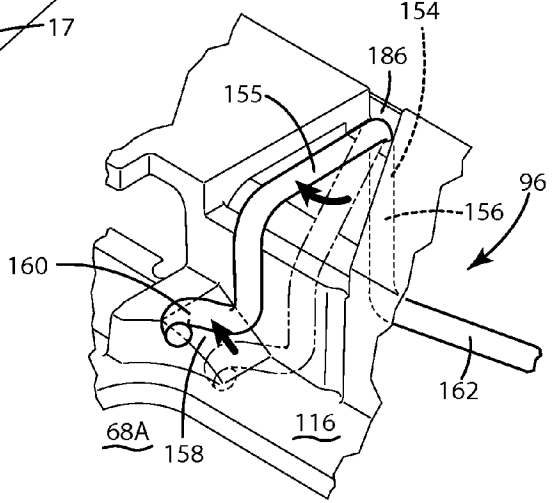
FIG. 8A is a partially fragmentary isometric view of a portion of the bracket assembly of FIG. 8.
Figure 8:
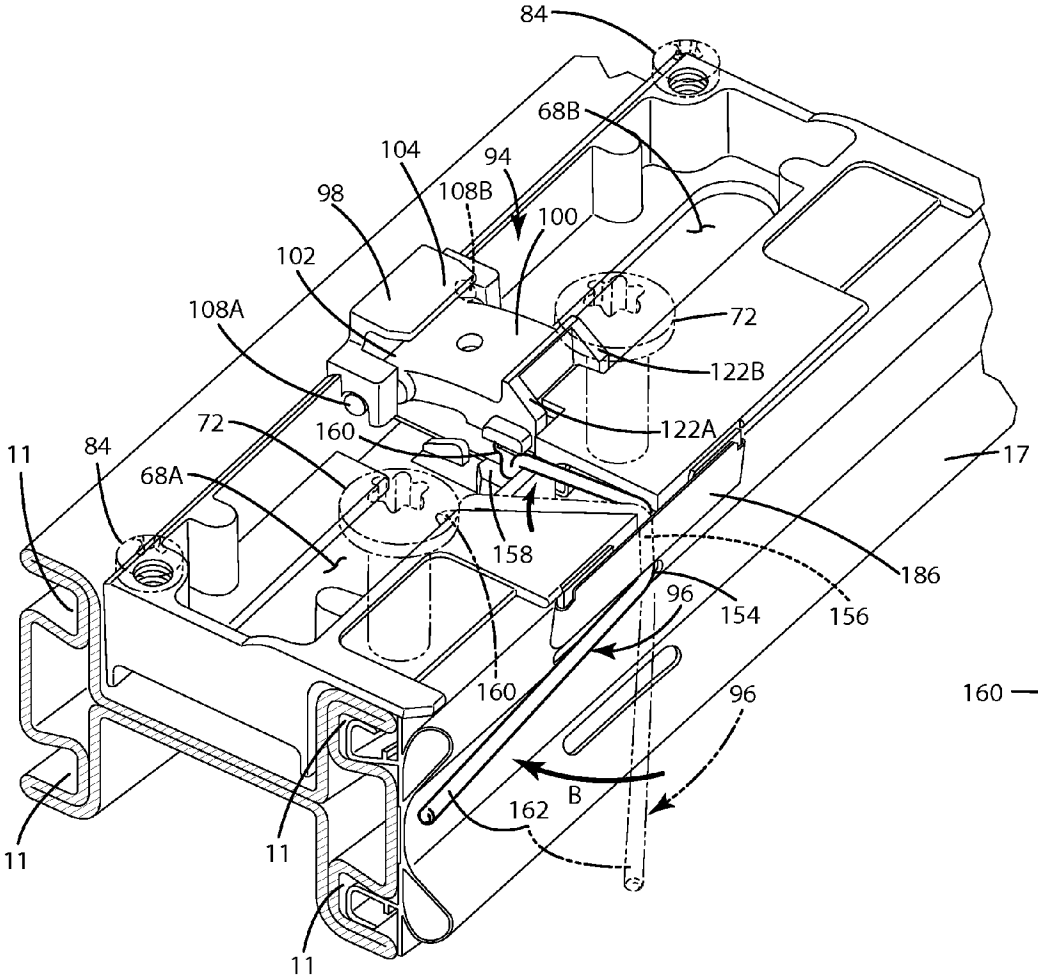
FIG. 8 is a partially fragmentary isometric view of a frame member and bracket assembly of the partition of FIG. 2.
Figure 9:
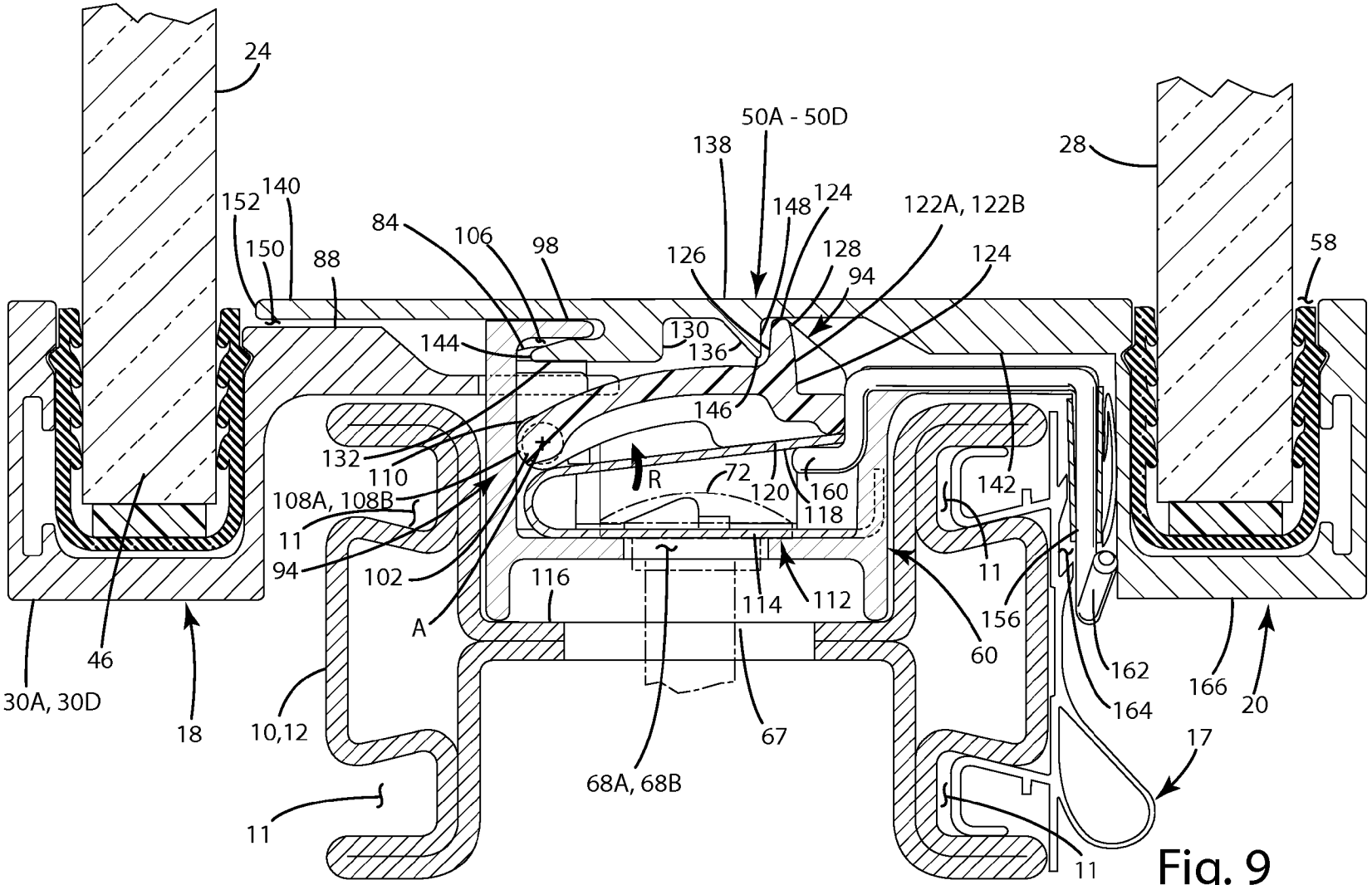
FIG. 9 is a partially fragmentary cross sectional view of a portion of the glass panel of FIG. 2.

With further reference to FIGS. 3, 8, and 9, after the second subassembly 20 is fully inserted into the frame opening 4 of partition frame 3, outer ends 162 of lock members 96 are rotated inwardly as shown by the arrow "B" (FIG. 8) to lock the movable retaining members 100 in an upper position to prevent inadvertent dislodgement or removal of second subassembly 20 from partition frame 3. Lock members 96 may comprise elongated wires that are somewhat flexible. Lock members 96 include central portions 154, connecting portions 155, inner end portions 160, and outer end portions 162. Lock members 96 are pivotably connected to base 62 at a pivot 156 formed by a clip 186 that engages central portions 154 of lock members 96. Rotation of lock member 96 about pivot 156 causes an inner end portion 160 of lock member 96 to slidably engage a sloped ramp surface 158 of base structure 62 of support bracket assembly 60 (see also FIG. 8A). As the lock member 96 rotates about the pivot 156, the end 160 of locking member 96 moves under the movable retaining members 100 directly adjacent lower surface 120 of movable retaining members 100 (FIG. 9). End 160 of lock member 96 prevents downward movement of the movable retaining members 100, such that the second subassembly 20 cannot be removed from partition frame 3 when the lock members 96 are in the locked position.

As the lock member 96 is rotated, engagement of lock member 96 with ramp surface 158 generates an upward force on inner end 160 of lock member 96. As outer end 162 of lock member 96 rotates to the fully locked position shown in FIG. 9, the outer end 162 of lock member 96 is received in a gap 164 between frame members 50A-50D and base structure 62 of support bracket assemblies 60. Because the lock members 96 are made of a flexible wire or the like, the outer end 162 flexes as it slides along an outwardly facing lower surface 166 of frame members 50A-50D, and the outer end 162 then snaps or flexes upwardly into a gap 164 when the lock member 96 is rotated to the fully locked position. In this way, the lock members 96 are hidden from view when they are in the fully locked position.

Figure 10:
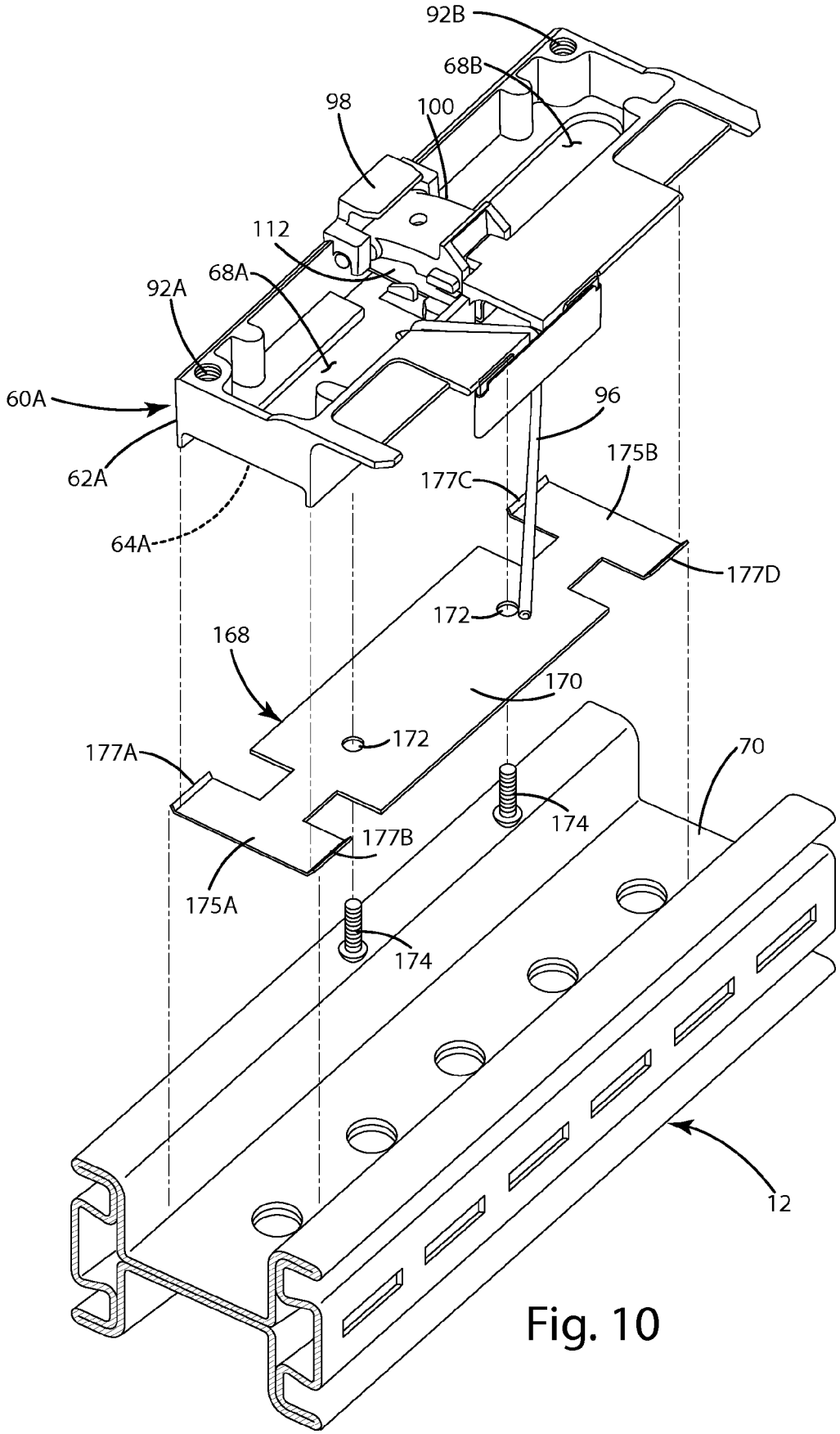
FIG. 10 is a partially fragmentary exploded isometric view of a bracket assembly and retaining clip according to another aspect of the present invention.
Figure 11:
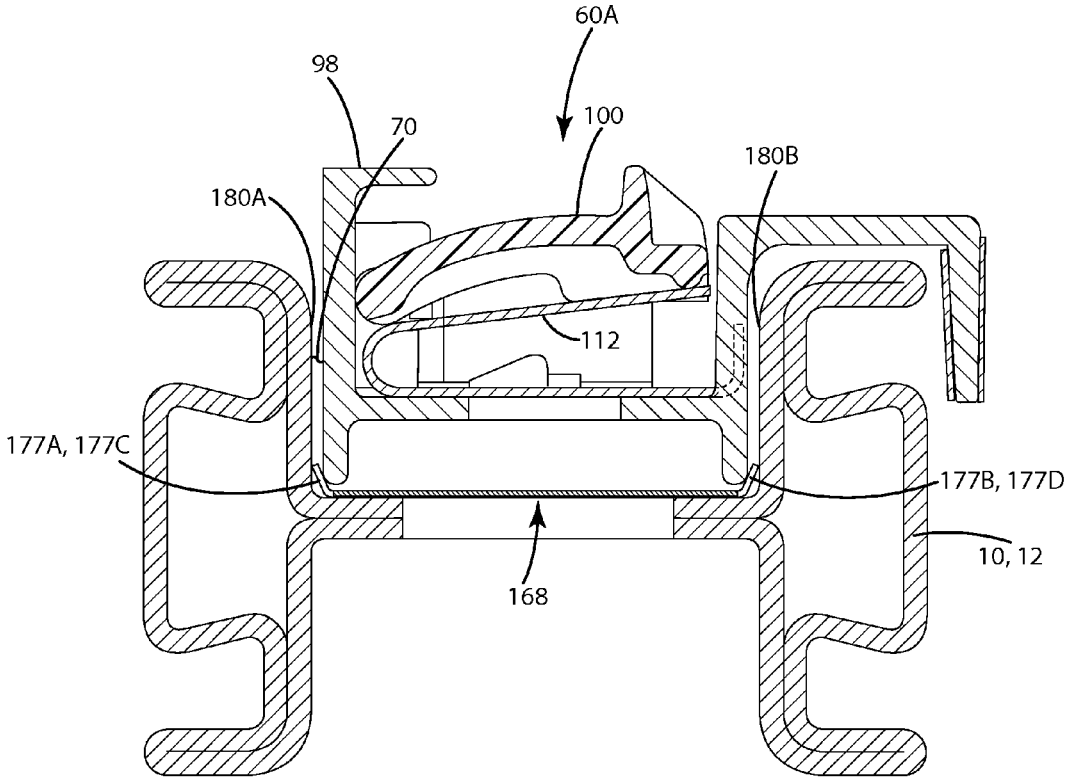
FIG. 11 is a cross sectional view showing the bracket assembly of FIG. 10 assembled with a partition frame member.

With further reference to FIGS. 10 and 11, a support bracket assembly 60A according to another aspect of the present invention includes a stationary retainer 98, a movable retaining members 100, and a spring clip 112 that are configured to retain the second subassembly 18 to partition frame 3 in substantially the same manner as described above in connection with the bracket assembly 60 of FIGS. 1-9. The support bracket assembly 60A includes a lock member 96 that locks the movable retaining members 100 in an upper position as described in more detail above in connection with FIGS. 1-9. A base structure 62A includes threaded openings 92A and 92B that receive screws 84 to retain the first subassembly 18 to the support bracket assembly 60A in substantially the same manner as described above in connection with FIGS. 1-9. However, the support bracket assemblies 60A are retained in channels 70 of partition frame members 10 and 12 by a retaining clip 168 rather than screws 72. As shown in FIG. 10, retaining clip 168 includes a central portion 170 having openings 172 that receive fasteners 174 to secure the retaining clip 168 to the bottom wall 64A of base structure 62A. Fasteners 174 may comprise threaded fasteners, rivets, spring clips/features or other suitable connectors. The retaining clip 168 also includes end portions 175A and 175B having angled flanges or edge portions 177A-177D.

With reference to FIG. 11, the support bracket assemblies 60A are secured to the partition frame members 10 and 12 by pushing the support bracket assemblies 60A into the channels 70 of partition frame members 10 and 12. The support bracket assemblies 60A can be pushed into channels 70 by hand, and rubber mallet or the like may be utilized to fully seat the support bracket assemblies 60A in channels 70. The angled edge portions 177A-177D of the retaining clip 168 slide along and engage the inner surfaces 180A and 180B of channel 70 of partition frame members 10 and 12, thereby retaining the support bracket assemblies 60A in the channels 70 of partition frame members 10 and 12. The angled edge portions 177A-177D provide a one way retainer that permits insertion of the support bracket assemblies 60A into the channel 70 of partition frame members 10 and 12, but prevents removal of the support bracket assemblies 60A from the channels 70. After the support bracket assemblies 60A are secured to the partition frame members 10 and 12, the first subassembly 18 and second subassembly 20 can be secured to the support bracket assemblies 60A in substantially the same manner as described in more detail above in connection with FIGS. 1-9.

Figure 12:
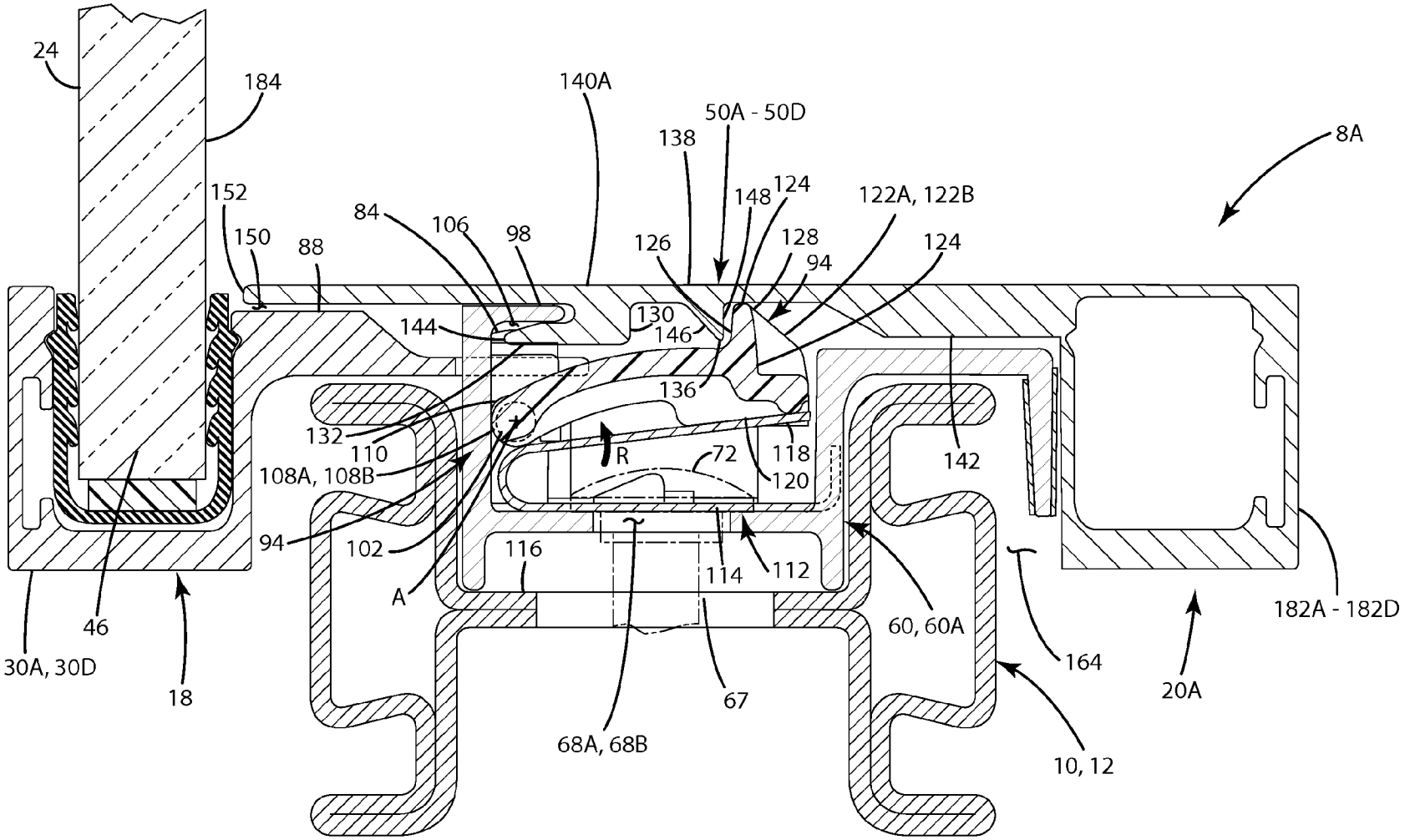
FIG. 12 is a partially fragmentary cross sectional view of a glass panel including a single sheet of light-transmitting material according to another aspect of the present invention.

With further reference to FIG. 12, a glass panel assembly 8A according to another aspect of the present invention includes a first subassembly 18 and a second subassembly 20A. The first subassembly 18 is substantially identical to the first subassembly 18 described in more detail above in connection with FIGS. 1-9, and it connects to connector or support bracket assemblies 60 or 60A as also described above. However, the second subassembly 20A of glass panel assembly 8A does not include a sheet of material 28, such that the glass panel assembly 8A has only a single sheet of material 24. The second subassembly 20A includes a plurality of subframe members 182A-182D that connect to the connector or support bracket assemblies 60 or 60A in substantially the same manner as the subframe members 50A-50D. However, upper surfaces 140A of subframe members 182A-182D are substantially flat, and the surfaces 140A do not include a channel 58 (FIG. 6) for retaining a sheet of glass or other material 28. As discussed above, the sheet of material 24 may comprise transparent, translucent glass or polymer. According to one aspect of the present invention, inner surface 184 of sheet 24 may comprise transparent glass or polymer that is partially or completely coated with paint or other opaque material. In this way, the glass panel assembly 8A may be configured to provide a decorative appearance that does not permit an observer to see through the sheet 24.

Figure 13:
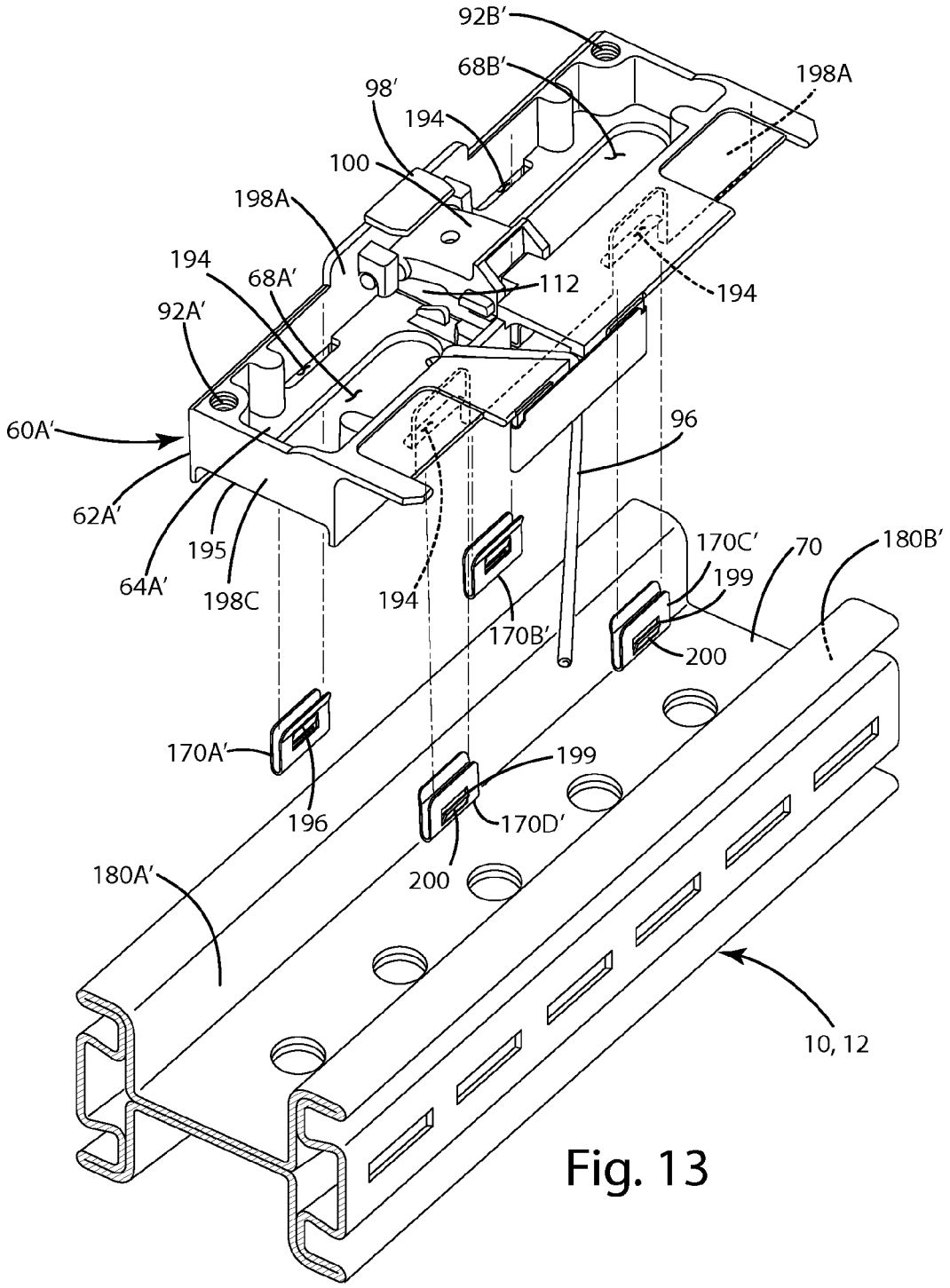
FIG. 13 is a partially fragmentary, exploded isometric view of a bracket assembly and retaining clips according to another aspect of the present invention.
Figure 14:
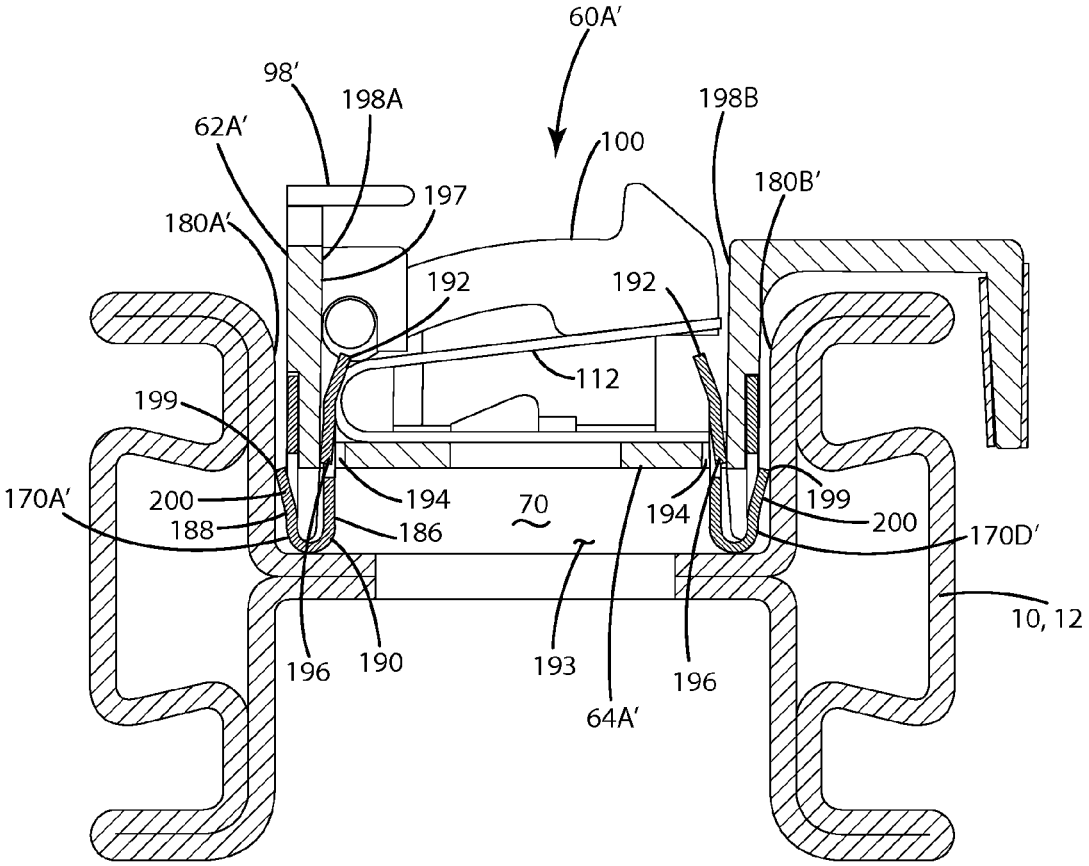
FIG. 14 is a cross sectional view showing the bracket assembly of FIG. 13 assembled with a partition frame member.

With further reference to FIGS. 13 and 14, a connector or support bracket assembly 60A' includes a base structure 62A' that may comprise cast aluminum or other suitable material. The connector assembly 60A' includes a stationary retainer 98' that may be integrally formed with base structure 62A'. Stationary retainer 98' is substantially similar to the retainer 98 described in more detail above. The connector assembly 60A' also includes a movable retainer 100 that is substantially the same as the movable retainer 100 described in more detail above. Support bracket assembly 60A' is secured in channels 70 of partition frame members 10 and 12 by spring clips 170A'-170D'. The spring clips 170A'-170D' are substantially identical to one another.

With reference to FIG. 14, spring clip 170A' is generally U-shaped in cross section, and includes inner and outer legs 186 and 188 that are connected by a U-bend 190. The spring clip 170A' may be made from spring steel or other suitable material. Upper end portion 192 of inner leg 186 extends through an opening 194 in bottom wall 64A' of base structure 62A'. The base wall 64A' of base structure 62A' may include four openings 194 as shown in FIG. 13 to accommodate four identical spring clips 170A'-170D'. Referring again to FIG. 14, spring clip 170A' includes a first retainer tab 196 that slidably engages inner surface 197 of sidewall 198A of base structure 62A' to thereby retain the spring clip 170A' on the base structure 62A'. Outer leg 188 of spring clip 170A' includes an angled tab 200 having an end or edge 199 that engages sidewall 180A' of channel 70 when base structure 62A' is installed into channel 70 of partition frame members 10 and 12 as shown in FIG. 14.

During assembly, the spring clips 170A'-170D' are first connected to the base structure 62A' by inserting the inner legs 186 of clips 170A'-170D' into the openings 194 in bottom wall 64A' of base structure 62A' such that the spring clips 170A'-170D' are retained on sidewalls 198A and 198B of base structure 62A'. The support bracket assembly 60A' is then pushed downwardly into the channel 70 of partition frame member 10 or 12, causing the resilient angled tabs 200 to deform and bend, with the edges 199 slidably engaging the sidewall surfaces 180A' and 180B' of channels 70. The edges 199 and angled tabs 200 provide a one way retaining mechanism whereby the support bracket assemblies 60A' can be installed into channels 70, but cannot be easily removed. However, if sufficient force is applied to the support bracket assembly 60A', the clips 170A'-170D' will disengage from the base structure 62A' and/or slide along the side surfaces 180A' and 180B' of channel 70. For example, a tool (not shown) can be inserted into gap 193 (FIG. 14) between lower surface 195 (FIG. 13) adjacent sidewall 198C of base structure 62A' to thereby pry on the base structure 62A' and remove the support bracket assembly 60A' from the channel 70. Clips 170A'-170D' allow connector assemblies 60A' to slide along channels 70 after the connector assemblies 60A' are installed (FIG. 14) to thereby permit adjustment of the location of the connector assemblies 60A'.

Figure 15:
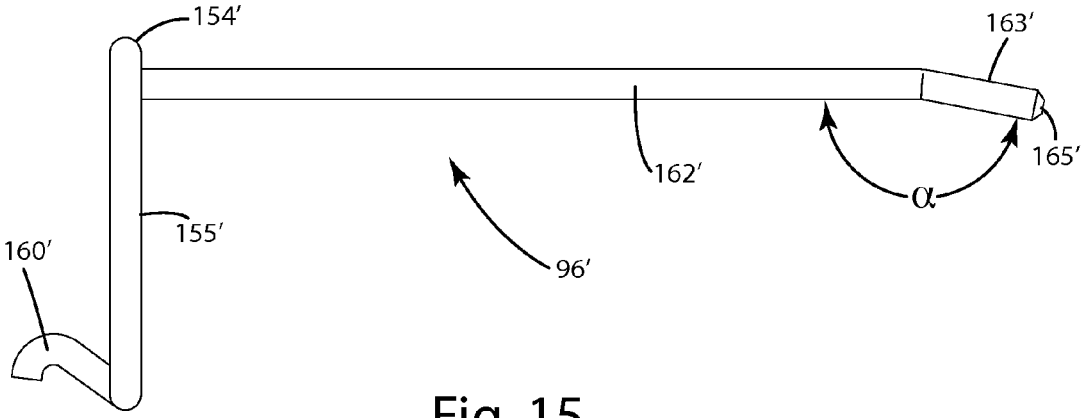
FIG. 15 is a top plan view of a lock member according to one aspect of the present invention.
Figure 16:
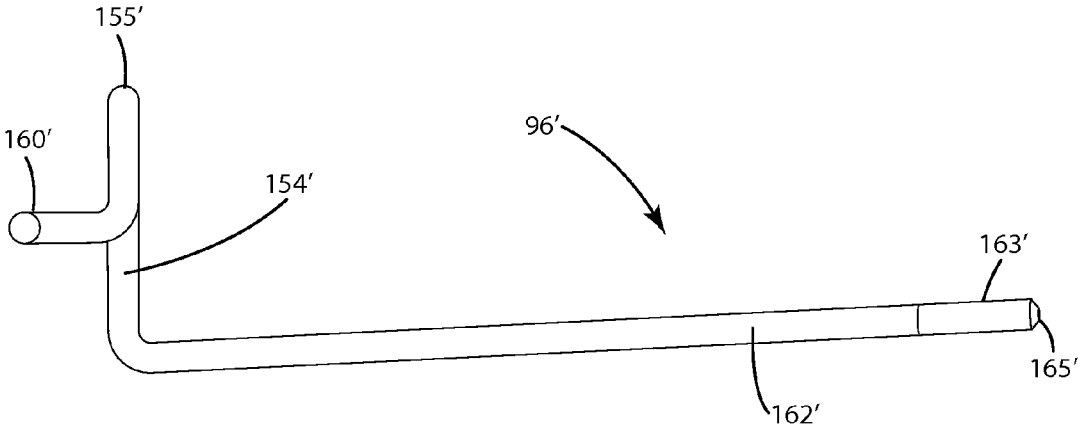
FIG. 16 is a side elevational view of the lock member of FIG. 15.
Figure 17:
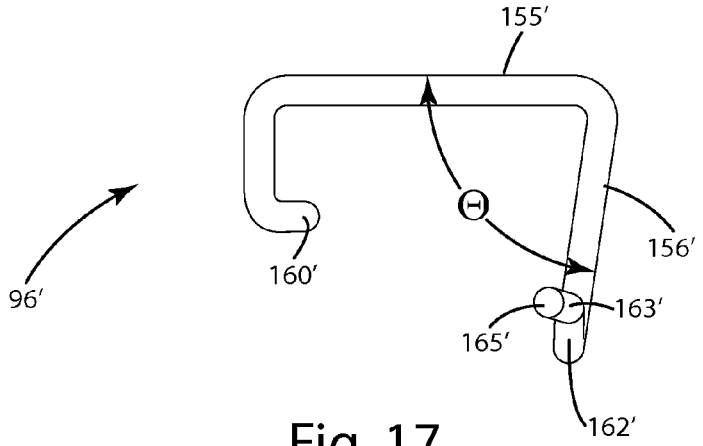
FIG. 17 is an end view of the lock member of FIGS. 15 and 16.

With further reference to FIGS. 15-17, a wire locking member 96' according to another aspect of the present invention includes an inner end 160' that is configured to selectively engage movable retainer member 100 in substantially the same manner as described in more detail above in connection with the lock member 96 of FIGS. 8 and 8A. Lock member 96' includes a central portion 154, a connecting portion 155, and an outer end portion 162'. As shown in FIG. 17, an angle θ is defined between the portions 155 and 156 of lock member 96'. The angle θ is preferably less than 90°, and most preferably about 82°. Because the angle θ is less than 90°, the end portion 162' is biased upwardly and/or inwardly, whereby the end portion 162 is pulled up into the gap 164 (FIG. 9) formed between partition frame members 50A-50D and partition frame members 10, 12.

Referring again to FIG. 15, the lock 96' also includes a tip portion 163' that forms an angle α relative to outer end portion 162. The angle α is preferably somewhat less than 180°, and more preferably about 170°. The angled tip portion 163' ensures that the tip 165' is spaced apart from partition frame member 10 even when the end portion 162' is disposed in gap 164. This ensures that the tip portion 163' can be accessed with a tool (e.g. a pair of pliers), whereby the tip portion 163 can be pulled out of the gap 164 by a user to permit rotation of retainer 96' to thereby unlock the retainer 96' and permit movement of movable retaining member 100 to its released position.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A partition comprising:

a partition frame including a pair of horizontally spaced apart upright partition frame members, and a pair of vertically spaced apart horizontal partition frame members that are connected to the vertical frame members to define a generally rectangular frame opening therebetween;

at least one connector assembly mounted to the partition frame adjacent the rectangular frame opening, the connector assembly including at least one movable retainer defining an engaged position, the movable retainer including a cam surface and a first retaining surface, and wherein the movable retainer is biased towards the engaged position;

a window subassembly configured to be installed to the partition frame at the frame opening, the window subassembly including a generally rectangular subframe defining a central opening, and including a sheet of glass or polymer material connected to the subframe and extending across the central opening, the subassembly including a connecting portion that is configured to initially engage the cam surface of the movable retainer as the window subassembly is moved into an installed position and to move the movable retainer away from its engaged position, followed by movement of the movable retainer to its engaged position due to the bias when the window subassembly is in an installed position on the partition frame, the connecting portions of the window subassembly including a second retaining surface that engages the movable retainer when the movable retainer is in the engaged position and retains the window subassembly on the partition frame in its installed position.

2. The partition of claim 1, wherein:

the connector assembly comprises a support bracket assembly including a base structure that is rigidly connected to the partition frame.

3. The partition of claim 2, wherein:

the movable retainer has a base end that is rotatably connected to the base structure.

4. The partition of claim 3, wherein:

the movable retainer includes a distal end portion having a tapered transverse extension, wherein the cam surface is formed on a first side of the transverse extension.

5. The partition of claim 2, including:

a lock member that is configured to engage the movable retainer and retain the movable retainer in its engaged position.

6. The partition of claim 1, wherein:

the sheet of material comprises glass.

7. The partition of claim 1, wherein:

the sheet of material comprises a polymer.

8. The partition of claim 1, wherein:

the sheet of material comprises a light-transmitting glass or polymer.

9. The partition of claim 8, wherein:

the sheet of material defines first and second opposite side surfaces and includes a layer of opaque material on at least a portion of the first opposite side surface.

10. The partition of claim 9, wherein:

the entire first opposite side surface is coated with a layer of paint.

11. A partition comprising:

a partition frame including a pair of horizontally spaced apart upright partition frame members, and a pair of vertically spaced apart horizontal partition frame members that are connected to the vertical frame members to define a generally rectangular frame opening therebetween;

at least one connector assembly adjacent the rectangular frame opening, the connector assembly including at least one movable retainer defining an engaged position, the movable retainer including a cam surface and a first retaining surface, and wherein the movable retainer is biased towards the engaged position;

a window subassembly configured to be installed to the partition frame at the frame opening, the window subassembly including a generally rectangular subframe defining a central opening, and including a sheet of glass or polymer material connected to the subframe and extending across the central opening, the subassembly including a connecting portion that is configured to initially engage the cam surface of the movable retainer as the window subassembly is moved into an installed position and to move the movable retainer away from its engaged position, followed by movement of the movable retainer to its engaged position due to the bias when the window subassembly is in an installed position on the partition frame, the connecting portions of the window subassembly including a second retaining surface that engages the movable retainer when the movable retainer is in the engaged position and retains the window subassembly on the partition frame in its installed position;

the connector assembly comprises a support bracket assembly including a base structure that is rigidly connected to the partition frame;

the movable retainer has a base end that is rotatably connected to the base structure;

the movable retainer includes a distal end portion having a tapered transverse extension, wherein the cam surface is formed on a first side of the transverse extension; and wherein:

the second retaining surface is formed on a second side of the transverse extension.

12. The partition of claim 11, wherein:

the second retaining surface generally faces the base end of the movable retainer, and the cam surface generally faces away from the base end of the movable retainer.

13. The partition of claim 12, wherein:

the connecting portion comprises a connecting flange extending from the subframe in a first direction and having an inner side that faces the frame opening, and an outer side that faces away from the frame opening, wherein the second retaining surface is formed on a retaining structure that extends from the outer side of the connecting flange.

14. The partition of claim 13, wherein:

the second retaining surface extends transverse to the first direction, and the retaining structure includes a sloped side surface that faces away from the retaining surface and defines an acute angle relative to the retaining surface to define a barb.

15. The partition of claim 14, wherein:

the sloped side surface is configured to slidably engage the cam surface of the movable retainer as the subassembly is moved into the installed position.

16. A partition comprising:

a partition frame including a pair of horizontally spaced apart upright partition frame members, and a pair of vertically spaced apart horizontal partition frame members that are connected to the vertical frame members to define a generally rectangular frame opening therebetween;

at least one connector assembly adjacent the rectangular frame opening, the connector assembly including at least one movable retainer defining an engaged position, the movable retainer including a cam surface and a first retaining surface, and wherein the movable retainer is biased towards the engaged position;

a window subassembly configured to be installed to the partition frame at the frame opening, the window subassembly including a generally rectangular subframe defining a central opening, and including a sheet of glass or polymer material connected to the subframe and extending across the central opening, the subassembly including a connecting portion that is configured to initially engage the cam surface of the movable retainer as the window subassembly is moved into an installed position and to move the movable retainer away from its engaged position, followed by movement of the movable retainer to its engaged position due to the bias when the window subassembly is in an installed position on the partition frame, the connecting portions of the window subassembly including a second retaining surface that engages the movable retainer when the movable retainer is in the engaged position and retains the window subassembly on the partition frame in its installed position;

the connector assembly comprises a support bracket assembly including a base structure that is rigidly connected to the partition frame;

a lock member that is configured to engage the movable retainer and retain the movable retainer in its engaged position;

the lock member is pivotably connected to the base structure for movement between locked and unlocked positions;

the base structure includes a sloped ramp surface; and the lock member slidably engages the sloped ramp surface as the lock member is pivoted from its unlocked position to its locked position whereby a portion of the lock member is shifted towards the movable retainer and prevents movement of the movable retainer from its engaged position.

17. The partition of claim 16, wherein:

the partition frame defines a first side face;

the subframe includes a perimeter flange structure having a base wall and a pair of spaced apart inner and outer sidewalls defining a U-shaped channel that receives an edge of the sheet of light-transmitting material, and wherein the connecting portion comprises a connecting flange that extends from the inner sidewall of the perimeter flange structure.

18. The partition of claim 17, wherein:

at least one of the horizontal partition frame members defines an outwardly facing vertical side surface adjacent the frame opening, and wherein the perimeter flange structure extends over at least a portion of the vertical side surface.

19. A partition comprising:

a partition frame including a pair of horizontally spaced apart upright partition frame members, and a pair of vertically spaced apart horizontal partition frame members that are connected to the vertical frame members to define a generally rectangular frame opening therebetween;

a plurality of connector assemblies around the rectangular frame opening, each connector assembly including a base structure directly connected to the partition frame and at least one movable retainer that is biased towards an engaged position;

a subframe comprising two pairs of elongated subframe members having opposite ends that are rigidly interconnected to define a generally rectangular central opening, the subframe further defining oppositely facing inner and outer side faces, the subframe including a connecting portion protruding away from the inner side face and engaging the movable retainer to connect the subframe to the connector assemblies; and at least one sheet of light-transmitting material secured to the subframe and extending across the central opening.

20. A partition comprising:

a partition frame including a pair of horizontally spaced apart upright partition frame members, and a pair of vertically spaced apart horizontal partition frame members that are connected to the vertical frame members to define a generally rectangular frame opening therebetween;

a plurality of connector assemblies around the rectangular frame opening, each connector assembly including a base structure and at least one movable retainer that is biased towards an engaged position;

a subframe comprising two pairs of elongated subframe members having opposite ends that are rigidly interconnected to define a generally rectangular central opening, the subframe further defining oppositely facing inner and outer side faces, the subframe including a connecting portion protruding away from the inner side face and engaging the movable retainer to connect the subframe to the connector assemblies;

at least one sheet of light-transmitting material secured to the subframe and extending across the central opening;

wherein the movable retainer includes a cam surface; and wherein the connecting portion includes an angled surface that is configured to slidably engage the cam surface and move the movable retainer away from its engaged position as the subframe is moved relative to the connector assemblies.

21. The partition of claim 20, wherein:

the movable retainers include barbed end portions defining the cam surfaces and an adjacent first retaining surface; and the connecting portion comprises a flange having a transverse extension forming the angled surface and an adjacent second retaining surface that engages the first retaining surface to connect the subframe to the connector assemblies.

22. The partition of claim 20, wherein:

each connector assembly includes a lock member that releasably engages the movable retainers when in a locked configuration and prevents disengagement of the movable retainers from the connecting portion of the subframe.

23. The partition of claim 20, wherein:

the movable retainers are pivotably connected to the base structures; and including:

a spring rotatably biasing the movable retainers towards the engaged positions.

* * * * *